US011610572B2

(12) United States Patent
Pilaar

(10) Patent No.: US 11,610,572 B2
(45) Date of Patent: Mar. 21, 2023

(54) ENHANCED INFLATABLE SOUND ATTENUATION SYSTEM

(71) Applicant: James G. Pilaar, Novato, CA (US)

(72) Inventor: James G. Pilaar, Novato, CA (US)

( * ) Notice: Subject to any disclaimer, the term of this patent is extended or adjusted under 35 U.S.C. 154(b) by 184 days.

(21) Appl. No.: 16/077,035

(22) PCT Filed: Feb. 8, 2017

(86) PCT No.: PCT/US2017/017060
§ 371 (c)(1),
(2) Date: Aug. 9, 2018

(87) PCT Pub. No.: WO2017/139411
PCT Pub. Date: Aug. 17, 2017

(65) Prior Publication Data

US 2019/0035376 A1 Jan. 31, 2019

Related U.S. Application Data

(60) Provisional application No. 62/388,942, filed on Feb. 10, 2016.

(51) Int. Cl.
*G10K 11/168* (2006.01)

(52) U.S. Cl.
CPC ..... *G10K 11/168* (2013.01)

(58) Field of Classification Search
CPC .... G10K 11/16; G10K 11/161; G10K 11/162; G10K 11/168
USPC ..... 181/290, 291, 293
See application file for complete search history.

(56) References Cited

U.S. PATENT DOCUMENTS 3,325,808 A * 6/1967 Manning ..... H01Q 17/007 342/3
3,497,606 A * 2/1970 Andrews ..... E04H 15/20 174/379
4,204,372 A * 5/1980 Agopyan ..... E04B 1/3448 52/64
5,270,092 A 12/1993 Griffith et al.
(Continued)

FOREIGN PATENT DOCUMENTS

CN 104968861 A 10/2015
JP 2002138591 A 5/2002
(Continued)

OTHER PUBLICATIONS

ISR PCT/US2017/017060.
Written Opinion PCT/US2017/017060.

*Primary Examiner* — William V Gilbert
(74) *Attorney, Agent, or Firm* — Shirley A. Recipon

(57) ABSTRACT

Disclosed is a compressible sound attenuation core, having one or more flexible, inflatable chambers, having one or more internal sound baffles. The chamber(s) can have at least one sound attenuation material affixed to a first predominant surface of the inflatable chamber(s). The sound attenuation core can be further framed by a novel extruded frame system that provides, inter-connectivity, support and integrity to form portable, modular sound attenuation panels that can be used to construct a variety of soundproofing devices, including but not limited to, partitions, walls, enclosures, structures, offices, aircraft hangars, and booths.

17 Claims, 24 Drawing Sheets

(56) References Cited

U.S. PATENT DOCUMENTS

| | | | | |
|---|---|---|---|---|
| 5,454,441 | A * | 10/1995 | Jines | B60V 3/025 180/125 |
| 7,992,678 | B2 | 8/2011 | Pilaar | |
| 8,469,144 | B2 * | 6/2013 | Pilaar | B32B 27/08 181/284 |
| 8,528,260 | B2 * | 9/2013 | Von Ballmoos | B64D 11/0023 52/2.11 |
| 2006/0009480 | A1 | 1/2006 | Qin | |
| 2006/0257600 | A1 | 11/2006 | Pilaar | |
| 2011/0173925 | A1 | 7/2011 | Brown | |
| 2011/0289857 | A1 | 12/2011 | Pilaar | |
| 2014/0110188 | A1 * | 4/2014 | Ichihashi | G10K 11/172 181/292 |
| 2015/0267403 | A1 | 9/2015 | Ho | |
| 2017/0053635 | A1 * | 2/2017 | Leon | B32B 3/266 |

FOREIGN PATENT DOCUMENTS

| | | | |
|---|---|---|---|
| JP | 2009149593 | A | 7/2009 |
| JP | 2009150203 | A | 7/2009 |
| JP | 2015-176017 | A | 10/2015 |
| WO | 2006119763 | A1 | 11/2006 |

* cited by examiner

FIG. 11

| Material | Thickness required in inches | | |
|---|---|---|---|
| | Moderately Noisy Office | Quiet Office | Very Quiet Office |
| Fir Plywood | 3.67 | 6.67 | 13.33 |
| Sand Plaster | 0.20 | 4.45 | 8.9 |
| Glass | 0.13 | | 9.3 |
| Dense Concrete | 0.14 | 4.85 | 12.2 |
| Aluminum | 0.13 | 5.7 | 11.3 |
| Steel | .0045 | 0.20 | 7.0 |
| Lead | 0.030 | 0.135 | 0.54 |

From Radiation Protection Products, Inc. (www.radiationproducts.com/acoustical-board.htm).

ENHANCED INFLATABLE SOUND ATTENUATION SYSTEM

CROSS REFERENCE TO RELATED APPLICATION

This application claims the benefit of U.S. Provisional Application No. 62/388,942, filed Feb. 10, 2016, entitled "ENHANCE INFLATABLE SOUND ATTENUATION SYSTEM" the disclosure of which is incorporated herein by reference in its entirety.

FIELD

The present teachings relate to an inflatable, noise attenuating, noise absorbing, noise diffusing, noise isolating, insulating, sound blocking and sound containing chamber, core, panel, barrier or enclosure, comprised of an inflatable core affixed thereto with an acoustic barrier material, resulting in the Inflatable Sound Attenuation Technology (the ISAT™ system). The ISAT system can be employed in a variety of structures and construction processes that benefit from a degree of soundproofing and/or insulation.

BACKGROUND

The present invention relates generally to structures employing the ISAT system to create soundproofing solutions that can be easy, rapid, less invasive to deploy than current solutions, portable, modular, compact, affordable and have a low carbon footprint in terms of transportation and shipping ease, weight and recyclability, providing further cost savings.

In today's society, there are often settings where it can be desirable to provide at least one or more of the following: noise attenuation, noise absorption, noise diffusion, noise isolation, insulation, sound blocking and sound containment, but these can be difficult to achieve. Examples include medical, military, transportation, architectural, recording, filming, event, therapeutic, entertainment and commercial applications within office buildings, trade show floors, outdoor venues and settings, apartments, condominiums, townhouses, single family dwellings with little separation there between and other structures that can be close together or include divisible spaces, interiors and rooms that can benefit from at least one of sound attenuation, insulation, blocking and containment. Occupants of these types of structures can wish to have quiet meeting areas, negotiation booths, music practice rooms or areas, home theaters, studios, children's play areas, yoga or prayer areas, medical speech privacy rooms, including protection from exterior, e.g., street noise, etc., but these can be difficult to obtain or create due to the lack of practical and affordable sound attenuation, insulation, blocking and containment systems.

Furthermore, sound attenuation, sound insulation, sound blocking and sound containment can be desired for brief periods of time, or at short notice and in situations where it is not practical or affordable to erect permanent sound barriers. These situations might include trade shows where a company might benefit from a soundproof booth or room for privacy concerns. Other situations might include road construction projects, where a temporary sound wall between a neighborhood and the construction area can be desirable, or even in the case of a military operation, where an inflatable aircraft hangar with sound attenuation properties can be deployed during the mission and then removed (or replaced with a permanent structure) when the initial mission is complete.

Accordingly, it is desirable to provide inflatable, (hence possibly a uni-structure) modular, and portable systems, devices and methods having at least one or more of properties including soundproofing, sound attenuation, sound insulation, sound blocking and sound containment. The disclosed inventions provide improvements in sound attenuation, sound insulation, sound blocking and sound containment for a wide variety of uses, including but not limited to personal, medical, military, transportation, architectural, recording, filming, entertainment, and commercial applications.

BRIEF SUMMARY

The present invention provides collapsible and portable sound attenuation devices and systems as well as novel extruded tube frames and methods for constructing soundproofed structures for a wide variety of personal, commercial, medical, military, transportation, architectural, recording, filming, entertainment, and commercial uses.

In one embodiment, disclosed is a compressible sound attenuation core having an inflatable chamber and one or more internal sound baffles within the interior of the inflatable chamber. The chamber can also have a first sheet of sound attenuation material (SAM) adherent to a first surface of the inflatable chamber referred to as a predominant surface as the predominant surface can be the visible surface. The chamber can also have a second sheet of sound attenuation material adherent to a second surface of the inflatable chamber opposite the first surface. The internal sound baffle(s) can be attached to opposite interior surfaces of the inflatable chamber as illustrated in FIG. 2B and can provide an undulating or substantially cuboidal exterior core surface, hence providing beneficial sound attenuation properties to the performance of the core.

In another embodiment, such baffles could be incorporated directly into the SAM to render it inflatable, rather than have both an inflatable chamber and a SAM attached to one another.

In one embodiment, disclosed is a compressible sound attenuation core having an inflatable chamber and one or more internal sound baffles within the interior of the inflatable chamber and a first sheet of sound attenuation material adherent to a first surface of the inflatable chamber referred to as a predominant surface as the predominant surface can be the visible surface. The chamber can also have a second sheet of sound attenuation material adherent to a second surface of the inflatable chamber, wherein the second sheet of sound attenuation material can be opposite the first surface of the inflatable chamber.

In another embodiment, the sound attenuation material is selected from the group consisting of polyvinyl chloride (PVC), lead-impregnated materials such as fabrics or plastics, mass loaded vinyl (MLV), TPU (Thermoplastic polyurethane such as ELASTOLLAN by BASF). In addition, flexible or rigid foams can also be used in addition to (or in lieu of) the SAM, to provide greater sound absorption capabilities to the panel. The fabrics or plastics can be selected from the group consisting of felts of various thickness, Terrastrand® fabric, fiberglass, and quilted fiberglass absorbers. The flexible or rigid foams can be selected from the group consisting of SONEX® foam, CFAB™ cellulose panels, melamine foam and polyurethane foam. In yet other embodiments, an acoustic panel(s) can also be attached to the sound attenuation core, panel/module and inflatable chamber.

In one embodiment, disclosed is a novel extruded rectangular tube to frame the sound attenuation core. The rectangular tube used to construct the frame has at the narrower dimension two parallel longitudinal channels along an inner surface, a central longitudinal opening, and a longitudinal groove, optionally having one or more notches, opposite the two parallel longitudinal channels and the two parallel longitudinal channels located below the central longitudinal opening; and the longitudinal groove can be above the central longitudinal opening while the wider, opposite sides of the rectangular tube are smooth and parallel. The interior of the longitudinal opening can have a longitudinal protrusion on opposite sides of the longitudinal opening that can be parallel to the longitudinal groove. In one embodiment the longitudinal groove can have at least one notch that opens into the longitudinal opening but leaves the protrusions intact.

In another embodiment, disclosed can be a sound attenuation panel having a compressible sound attenuation core and an extruded frame providing tensile strength and structural integrity. The frame can have at least one longitudinal channel or at least one longitudinal groove that can receive the perimeter edge of a sheet of sound attenuation material attached to a predominant surface of an inflated inflatable chamber.

In another embodiment, disclosed can be a sound attenuation structure, aka an ISAT system having a plurality of sound attenuation panels (a Structural Silence Panel) to form a partition, wall, booth, soundproof enclosure, room, theater or shell. The sound attenuation structure can further have a service selected from the group consisting of an electrical outlet, a security keypad lock, alighting system, an internet router system, a speaker system, alighting system (such as LEDs, which can be individually programmed per panel to create effects such as scrolling text, light shows, etc.), an A/V system, and an HVAC system.

In another embodiment, a sound abatement insert having a compressible sound attenuation core plus a SAM barrier can be envisioned. The sound abatement insert can have at least one layer or at least two layers of SAM. When two layers of SAM are present they are affixed to opposite predominant surfaces of the sound attenuation core. In another embodiment, two sound abatement cores can be placed between three layers of SAM such that a layer of SAM can be on each exterior surface of each sound attenuation core and the third layer can be between and affixed to each adjacent interior surface of the two sound attenuation cores (a 'Club Sandwich' design.)

In another embodiment the sound abatement insert can be attached to a non-structural frame to form a Non Structural Silence Panel. The frame can be made, for example of a flexible and/or semi-rigid material such as Acrylonitrile butadiene styrene (ABS), polycarbonate and the like. Structural integrity can be achieved by use of a Tent Pole Cage (i.e. a framing structure that uses horizontal and/or vertical and/or angled rigid elements made of aluminum, carbon fiber, or other materials used to hold up the poles). The non-structural silence panels can be affixed to the tent pole structure for structural support to construct an enclosure or structure. Such tent poles are commonly used in, for example, portable structures such as tents, farmer's market stands, art show exhibit booths, trade show booths, etc.)

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

Journal papers, manuscripts, books, text books, patents and published patent applications, URLs and doi journal references as cited herein are incorporated herein by reference in their entirety for all purposes.

Definitions

As used herein the terms "inflatable core" and inflatable chamber" can be used interchangeably and can refer to an inflatable device having at least one chamber and one or more sound baffle(s) within the chamber interior of the inflatable core.

As used herein, the terms "sound baffle" and "baffle" can be used interchangeably, and can refer to at least one device within the interior of the inflatable core which can be affixed to at least one interior predominant surfaces within the interior of the inflatable core. The baffle can also be affixed to an interior side surface of the inflatable core, and to an additional chamber inside the core, if a core consists of more than one inflatable chamber. The baffle can have a two- or three-dimensional shape, including but not limited to a planar, an angular, a cuboidal, a conical, a pyramidal, and concentric shape. The baffle(s) not only assist in establishing a substantially cuboidal surface for the predominant barrier surface of the inflatable core but the number of baffles can be varied in, placement, height, shape, diameter(s), etc. to facilitate and contribute to a flat (parallel predominant surfaces), undulated, protruding (convex), depressed (concave) or corrugated surface(s) of the inflatable core. The possibility to further augment the inflatable core with additional inflatable chambers and/or core sound baffles, each filed with the same or a different gas or fluid or solid or a combination thereof, can provide enhanced sound attenuation.

As used herein, the terms "sound attenuation core", "sound attenuation chamber", "Inflatable Sound Attenuation Core" and "Compressible Sound Attenuation Core" can be used interchangeably and can refer to an inflatable and compressible device having at least one inflatable chamber and one or more sound baffles within the interior of the inflatable chamber. The sound attenuation core provides a component of a 'tunable building block' device for sound attenuation, absorption and diffusion depending on the level of inflation, inflation material, and number, placement and configuration of chambers and/or baffles in the inflatable core, which can be modified at will depending on the frequency of noise the user can be trying to attenuate. In addition the sound attenuation core can have one or more layers of one or more of the same or different sound attenuation materials (SAMs) affixed to one or both predominant exterior surfaces of the inflatable core.

The terms "sound attenuation material (SAM)" and "SAM Barrier" can be used interchangeably and as used herein can refer to a flexible plastic, fabric, felt or foam material, with or without the material being impregnated with a metal or other materials that provide mass, including but not limited to lead, barium salts, silica, etc. for attenuating and absorbing sound waves, particularly the lower frequency sound waves. Examples of SAM materials include but are not limited to Mass Loaded Vinyl (MLV), High Mass/High Density PVC or TPU (Thermoplastic polyurethane) as well as Composite MLV and Absorptive Foam Barrier, and so on, as is known to one of skill in the arts of acoustics and sound abatement.

As used herein, the terms "panel" and "module" and "ISAT Panel" and "Structural ISAT Panel" and "Non-Structural ISAT Panel" can be used interchangeably and can refer to a compressible, portable, modular soundproofing device having at least one frame, including but not limited to an extruded frame, surrounding and containing an inflatable and compressible sound attenuation core device and having at least one sheet of a SAM affixed to the sound attenuation core. The SAM material can be affixed to the frame. Depending on the soundproofing application the panel can have two frames containing at least one sound attenuation core, with at least one layer of SAM on the opposing predominant surfaces whereby each same layer can be affixed to opposite frames. The frames could be considered the bread in a sandwich and the attenuation core the interior. A "club sandwich" would have three frames and at least three SAM sheets. The center SAM sheet being affixed on a first face to the top sound attenuation core and on the opposite second face to the bottom sound attenuation core and can be mounted into the center frame. Additional SAM layers can also be added, if desired, for increased sound abatement benefits.

The connected arrangement of panels can from walls, partitions and enclosures to provide soundproofing structures. The structures can be free standing for use in interior and exterior applications.

The terms "Insert" or a "Sound Abatement Insert" or a "Sound Attenuation Insert" can be used interchangeably and can refer to an inflatable, compressible, portable, modular soundproofing device, and having an inflatable and compressible inflatable chamber and at least one sheet of a SAM affixed to the inflatable chamber. In other words, a "Panel" as described above but without a frame, a Non-Structural ISAT Panel.

The terms "attenuate" and "abatement" can be used interchangeably and as used herein refer to the loss of energy as sound wave vibrations migrate through a media. The loss of energy corresponds with a loss of sound intensity perceived as reduction in the sound as generated from its source and also considered a reduction in "noise" which can be an unwanted sound.

The term "diaphragmatic absorption air cavity" as used herein can refer to a flexible surface including but not limited to a SAM. The SAM vibrates and absorbs sound wave energy and as the sound wave passes through the inflated chamber, the chamber can absorb and diffuse the sound wave such that it doesn't fully penetrate the SAM on the opposite side of the inflatable chamber. The result can be an attenuation and diffusion of the original sound. In one embodiment, sound attenuation performance can be better because there can be no "hard" or direct connection between SAM Barriers due to the fact that they are separated yet held together by the flexible core filled with e.g., air.

The terms "frame" and "Structural Frame" can be used interchangeably and as used herein can refer to custom-made extrusions as well as "off the shelf" and commercially made extrusions. The frame can be made to any size and of a variety of materials, e.g., aluminum, plastics and polycarbonate as is known to one of skill in the art.

The phrase "Inflatable Sound Attenuation Technology" (ISAT) and "ISAT System" can be used interchangeably and can refer to a device having one or more inflatable chambers having one or more baffles and having affixed thereto at least one acoustic SAM barrier material. With the addition of a frame a Structural ISAT Panel can be formed and absent a loadbearing frame a Non-Structural ISAT Panel. The ISAT system can be employed in a variety of structures and construction processes that benefit from a degree of soundproofing and/or insulation. The ISAT system can be used for a variety of applications where sound abatement can be desired, including but not limited to, noise attenuation, noise absorption, noise diffusion, noise isolation, insulation, sound blocking and as a sound containing chamber, core, panel, barrier or enclosure.

Sound can be attenuated by controlling the amplitude (magnitude of the oscillation-which impacts the Loud factor) and/or the duration (length of time the sound lasts). Sound Attenuation Materials c an both absorb noise energy by preventing reflection of sound and as a barrier to prevent sound from getting to the opposite side of the ISAT panel from its originating side. When sound travels through an ISAT module, the diaphragmatic absorption effect of the flexible, pressurized core, combined with the viscoelastic nature of the SAM barrier, converts sound vibrations into minute amounts of heat and dissipates the sound through the material, resulting in significant Sound Transmission Loss (STL).

BRIEF DESCRIPTION OF THE DRAWINGS

The accompanying Figures illustrate various aspects and components of devices and systems in accordance with the present invention.

FIG. 11 presents common soundproofing materials and the thickness required to achieve varying levels of soundproofing.

DETAILED DESCRIPTION OF VARIOUS EMBODIMENTS

Figure 1A:
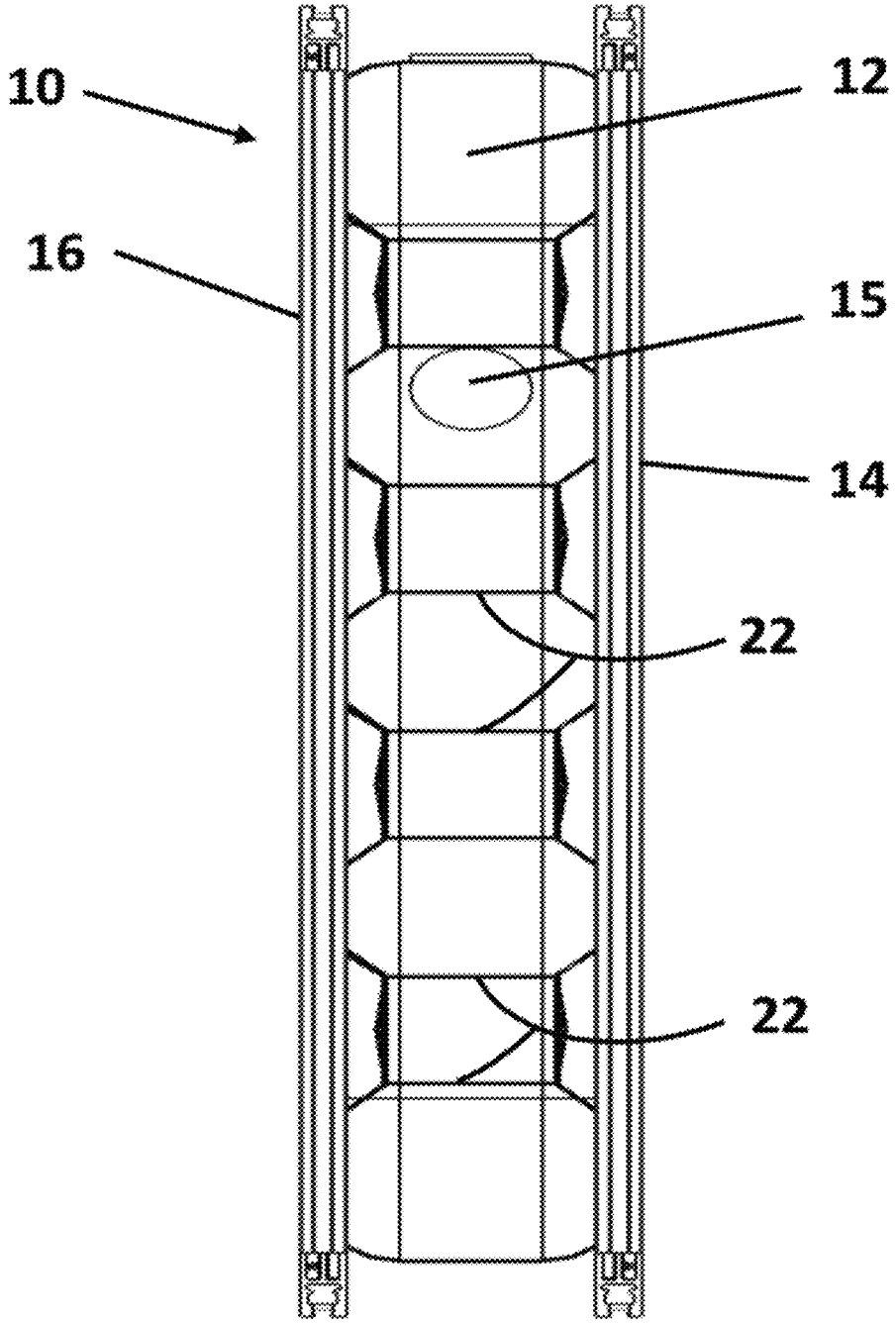
FIG. 1A is a cross-section view of an inflated sound attenuation panel with an inflated inflatable core according to one embodiment ("Regular Sandwich")

Disclosed herein are embodiments of an ISAT system and components for sound attenuation, sound insulation, sound blocking and sound containment to deliver noise attenuation, noise absorption, noise diffusion, noise isolation, insulation, sound blocking and sound containing. The composition of the ISAI system's components and methods for utilizing the system, methods and kits to self-assemble are provided.

Reference will now be made to various embodiments, examples of which are illustrated in the accompanying drawings. It is noted that the drawings are illustrative and sizes, dimensions and proportions are not to be construed from the drawings, as embodiments illustrated are not to scale.

As described below, it will be appreciated that the disclosed inflatable core, inflatable panels, sound attenuation material (SAM) augment the inventive inflatable sound attenuation cores, enclosures and rooms, framing system(s), panels, partitions, walls, booths and structures, all of which have several unique advantages. As used herein the inflatable core refers to a flexible, inflated chamber or chambers. The terms SAM-augmented inflatable core or SAM-augmented core, are used interchangeably and as used herein can refer to at least one of the predominant surfaces of the inflatable core having affixed thereto at least one SAM, including but not limited to, a high mass vinyl also known in the art as mass loaded vinyl (MLV).

MLV is a product well known to those skilled in the art and meets most building codes throughout the United States and Canada. MLV can contain barium salts and silica, or be made of high-mass/high-density PVC, providing soundproofing qualities comparable to lead but absent the associated hazards and issues connected to lead. MLV can be stapled or glued between drywall sheets or wood panels, e.g. to reduce sound in floors or wooden structures as well as hanging curtain to diminish airborne noise. MLV can possibly add from 5-10 STC points depending on how it can be applied to a partition. The deployment of MLV for soundproofing purposes can be usually a messy, invasive process.

The disclosed invention provides improvements in sound attenuation as well as an innovative frame structure, providing for very easy deployment and reuse of SAMs such as MLV. The inventor is also the sole inventor of U.S. Pat. No. 7,992,678, issued on Aug. 9, 2011 and U.S. Pat. No. 8,469,144, issued Jun. 25, 2013, each entitled "Inflatable sound attenuation system" the disclosures of which are incorporated herein by reference in their entireties for all purposes.

The advantages and improvements of the disclosed inflatable core and SAM-augmented core, in one embodiment, include the absence of fibers in the inflatable components, SAMs, frames and coupling devices—a necessity for use in clean room (dust-free) environments and applications. The construction of the inflatable core, SAM-augmented core, sound attenuation panel (SAM-augmented core within a frame), modularity of panel assembly and connectivity of cores, SAM-augmented cores and panels provide for ease of portability, assembly, storage when not in use and can be easily transported in a passenger car or truck, elevator and the like. The core, panel, chamber and structure are, in one embodiment, each compactible to a size when not inflated to allow ease of storage, i.e., a small footprint such that it can fit under, behind furniture. Due to the relatively (compared to other soundproofing options) low weight of each inflatable core, core plus frame, sound attenuation panel, the resulting packaging and shipping can be simple and at a lower cost versus traditional soundproofing solutions and has a low carbon footprint for transportation, and with many of the panel's components being recyclable it can be more environmentally friend versus other soundproofing options. A further advantage of the inflatable core and SAM, whether alone but also in combination, can be that each provides insulating, R values to retain heat in cold environments and cooling air in hot environments, as well as the sound transmission Class (STC) (sound blocking) values and Noise Reduction Coefficient (NRC): (sound absorption) values. Additionally, both the core material and the SAM can be modified to provide UV-A and UV-B protection and filtering to preclude heat build-up as well as fading and deterioration of textiles and works of art. In one embodiment, due to the rigidity of the frame used to create the panels, partitions, walls and enclosures as described herein as well as envisioned by one of skill in the art, each can be created with these 'stand alone' panels without the need for additional/external supports; and, due to the light weight and thin y et strong profile, the frame can be only about ½" thick, and when compressed, the panel can be only about 1" thick while the final inflation thickness can be from about 1.5", about 2", about 3", about 4", about 5", about 6", about 7", about 8", about 9", to about 10" thick or more as well as incremental widths between about 1.5" to about 10" or more thick. In one embodiment of the disclosed innovative frame 55 of FIG. 3A, the presence of two parallel channels provides a channel for adhering at least one SAM. The SAM can be bonded to the frame, and the SAM bonded to the core(s), with a clear bonding agent (e.g. VLP glue,) a UV-enabled bonding agent such as a Loctite clear acrylic adhesive, acoustic caulk (e.g., Green Glue Noiseproofing compound—www.greengluecompany.com), as well as Velcro@ strips or screwed to the frame as is known to one of skill in the art. The other channel can provide attachment for a coupling device to secure the panel or chamber to a floor base plate or other uses as would be appreciated by the skilled artisan. In another aspect, the longitudinal groove 56 on the outer edge of innovative extruded frame 55 can receive a gasket contoured to the groove to provide a barrier to sound leakage between two adjacent frames as is known to one of skill in the art.

The present invention provides compositions including a flexible, inflatable core, the core being enclosed in at least one sound attenuation panel, used to construct an acoustic barrier structure and methods for assembling and installing one or more cores, panels or structures, creating partitions, walls and enclosures with or without roofs and/or doors. FIG. 1A illustrates a cross-section view of a sound attenuation panel 10 with an inflated core 12 attached to internal and external facing frames 14 and 16, respectively. As used herein a sound attenuation panel comprises an inflatable core, at least one sheet of a SAM (not shown) affixed to the core on a predominant surface (not shown) and at least one frame. The dimensions of a panel can be any size with respect to length, width and height. For illustrative purposes only, the panel represented in the drawings has a length of 24", height of 27" and an inflated width of about 4.25" with a frame thickness of about ½" to about 20 mm depending on the frame embodiment illustrated. As shown, panel 10 includes an inflatable core 12 that when inflated with air or other fluid, e.g., liquid or gas, provides substantially cuboidal predominant surfaces. Valve port 15 is shown on a side of panel 10 but can be on a predominant surface. Valve port 15 can be coupled with a pump mechanism to allow for inflation (and deflation) of inflatable core 12 and can be located on a side or a barrier surface 19 (FIG. 2A) of an inflatable core, and in general anywhere on an inflatable core convenient for inflation individually, serially or in tandem. In addition, valve ports can be linked together in series to provide simultaneous inflation of cores joined in series. Panel 10 is showed with core 12 having a plurality of internal sound baffles 22 in FIGS. 1A and 2B, for example.

In one embodiment, an inflatable core can contain more than one gas, solid or fluid-receiving chambers, at least one or a plurality of internal sound baffles 22 such that when filled the core's predominant surfaces are substantially cuboidal. In certain aspects, the general overall shape of a predominant surface can be substantially cuboidal to its opposite surface. The predominant surfaces of sound attenuation panels and acoustic barrier structures will be referred to herein as barrier surfaces 19 as these surfaces can possibly be visible and define the sound attenuation panel and acoustic barrier dimensions. The core 12 can be preferably made of PVC, polyurethane, TPU (thermoplastic polyurethane) or other plastic or polymer or co-polymer material, or rubber, and the barrier surface 19 can have but is not limited to a flat, planar, undulated, protruding, convex, concave, or corrugated surface. In one embodiment, only one barrier surface includes at least one layer of sound attenuation material (SAM) attached thereto. In one embodiment, the SAM includes mass-loaded vinyl (MLV), however, other materials with useful sound attenuation characteristics can be used. Examples of other useful sound attenuating materials include but are not limited to High-Mass/High-Density PVC, TPU, lead- and other metal-impregnated materials such as fabrics or plastics, as well as other flexible or rigid materials, such as fabrics, foams or plastics. MLV is a commercially available material, and can be obtained in different thicknesses with different weights, including but not limited to a weight of one-half pound per square foot, three quarters of a pound per square foot, one pound per square foot, two pounds per square foot, or greater weight and in different opacities (e.g., opaque, transparent and translucent) as is known to one of skill in the art.

In another embodiment, a sound attenuation layer can be attached to the barrier surface of the inflatable core using glue, UV cured bonding methods or other adhesive material, however, other attachment elements such as Velcro® adhesive strips, ties, etc., can be used. It should be appreciated that a sound attenuation layer can include multiple sound attenuation layers (e.g., a stack of one or more sheets of the same or different SAMs). In one embodiment, these stacks can be composed in a manner that provides for as many air pockets as possible between the additional layers of SAM, to provide additional sound attenuation benefits. Additionally, when additional sound absorption can be required, the panel can be modified to include a sound absorbing open-cell foam material including but not limited to SONEX® panels made from Willtec® foam as is known to one of skill in the art.

Figure 1B:
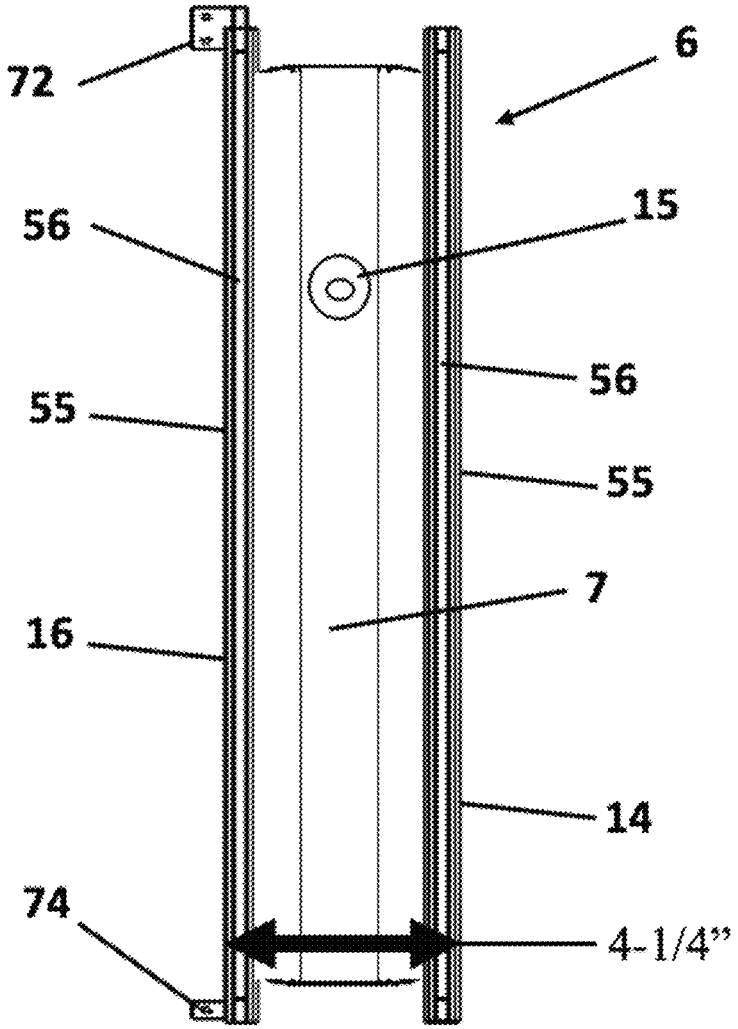
FIG. 1B is across-section view of another embodiment of an inflated sound attenuation panel with an inflated inflatable core and a full edge and half edge connecting brackets according to one embodiment.
Figure 3A:
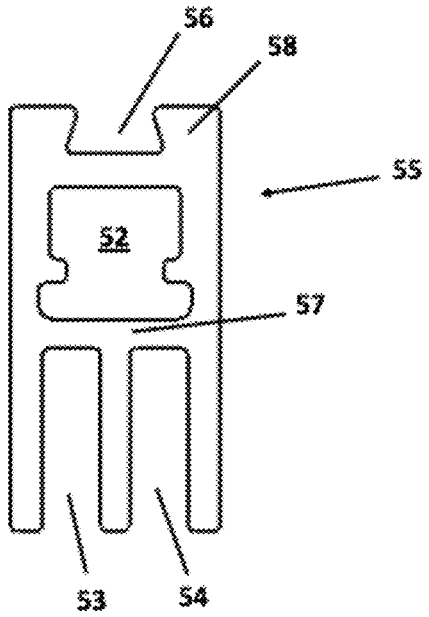
FIG. 3A is a transverse section view of an extruded frame innovation according to one embodiment.
Figure 3B:
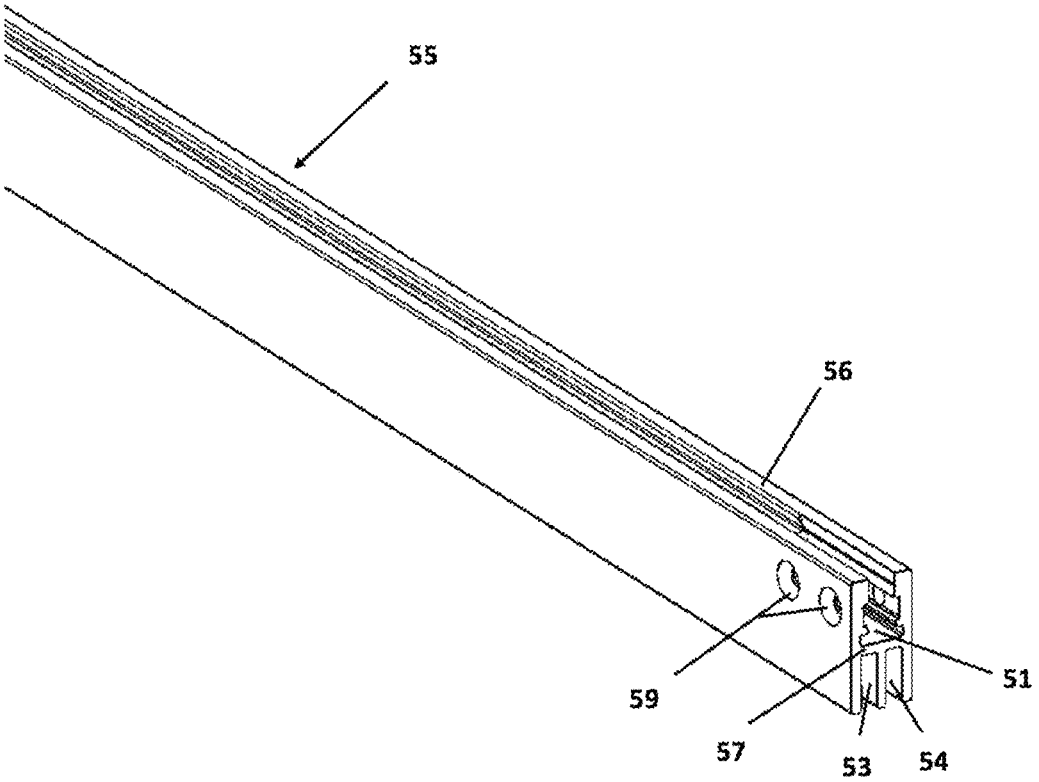
FIG. 3B is a longitudinal perspective view of the innovative extruded frame of FIG. 3A.

FIG. 1B illustrates another embodiment of chamber 12 absent internal sound baffles. Panel 6 with inflated chamber 7 attached to SAM (not shown) and the SAM secured to extruded straight tubes 55. Also illustrated are full edge 72 and half edge 74 connecting brackets. The full edge bracket 72 can join four panels together where the four frame corners meet and the half edge 74 bracket can join two end panels, one atop the other, when positioned vertically or two adjacent top panels, as in a wall or partition when positioned linearly and adjacent to one another. The brackets can be inserted into a recess/notch 51 formed by removing about ½-about 1" of groove base 58 which forms the bottom surface of groove 56 at opposite ends of frame 55 as illustrated in FIGS. 3A and 3B.

Figure 1C:
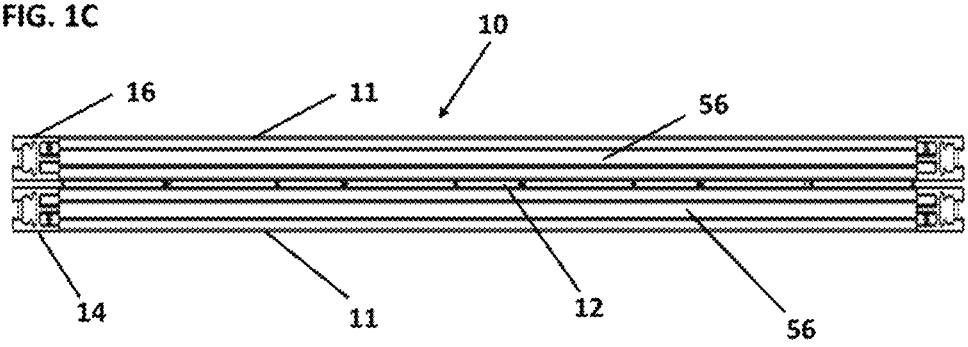
FIG. 1C is across-section view of a compressed sound attenuation panel with a compressed inflatable core for shipping or storage according to one embodiment.

In one aspect, panel 10 can be portable and flexible/compressible to allow the inflatable core to be compressed between the frames surrounding/attached to the core to allow for ease of storage and transport. FIG. 1C illustrates a panel 10 with inflatable core 12 attached to frame 55 in a deflated state. As shown, the panel can be in a flattened/compressed configuration. Due to the light weight and thin yet strong profile, the frame can be only about ½" thick, and when compressed, the panel thickness can be only about 1" thick while the final inflation thickness can be from about 1.5" to about 10" thick or more. Such compressibility provides compact packaging of a plurality of panels for shipping as well as the ability to slide deflated panels under or behind furniture or in a closet or other limited-size storage area when not in use. As the thickness of the compressed panel 10 of FIG. 1C can be about 1", it can be easily envisioned greater than 60 panels stacked in an area about 24" by 27" about 65" high, not even the size of abasic clothes closet. This can be a significant improvement and provides a benefit heretofore unknown in soundproofing. A large number of panels can be shipped in a single container, providing a desirable environmental benefit compared to other soundproofing materials (i.e. panels ship at less than 25% of their deployed/inflated size.) In one embodiment, the use of clear MLV makes additional lighting inside an enclosure made of IATS panels unnecessary, therefore saving on power needs and the greenhouse gases associated with them.

In another embodiment, the diameter of an extruded tube can be at least 1.5×, 2×, 3× or more greater than the about 14 mm (~9/16") thick×29 mm (~15/16") depth frame described above depending on the application. For example, much larger and thicker frames, including but not limited to frames use in industrial structures including but not limited to inflatable freeway walls or inflatable soundproofed aircraft engine run-up hangars. These structures can be portable, such as transported on a flatbed truck for inflation at the selected sight.

Figure 1D:
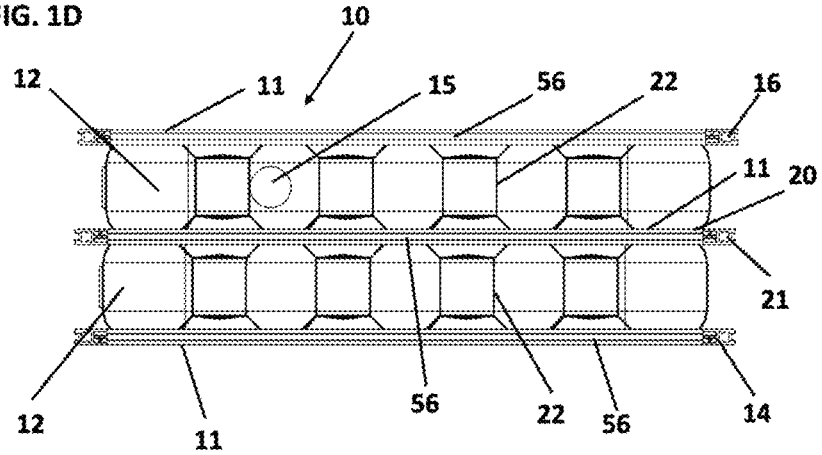
FIG. 1D is across-section view of a 'Club Sandwich' sound attenuation panel with two inflated inflatable cores and three layers of SAM according to one embodiment.
Figure 1E:
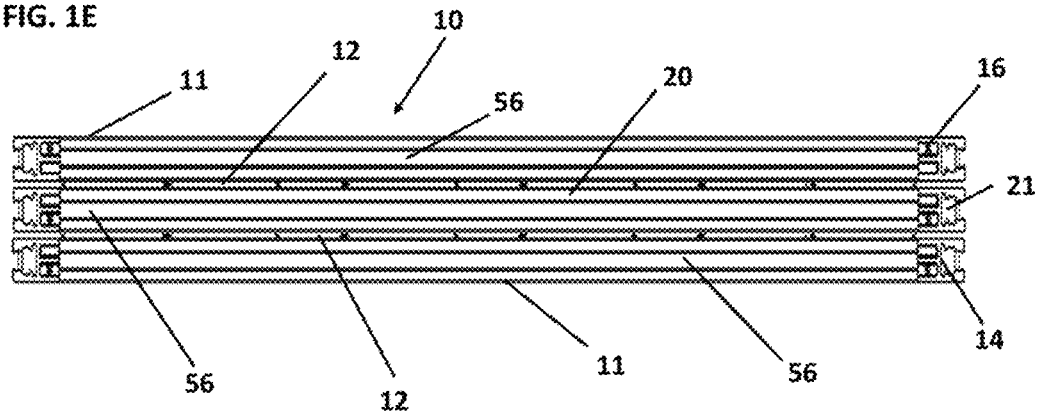
FIG. 1E is a cross-section view of FIG. 1D is a "Club Sandwich" panel, with two compressed inflatable cores, and three layers of SAM, compressed for shipping or storage according to one embodiment.
Figure 1F:
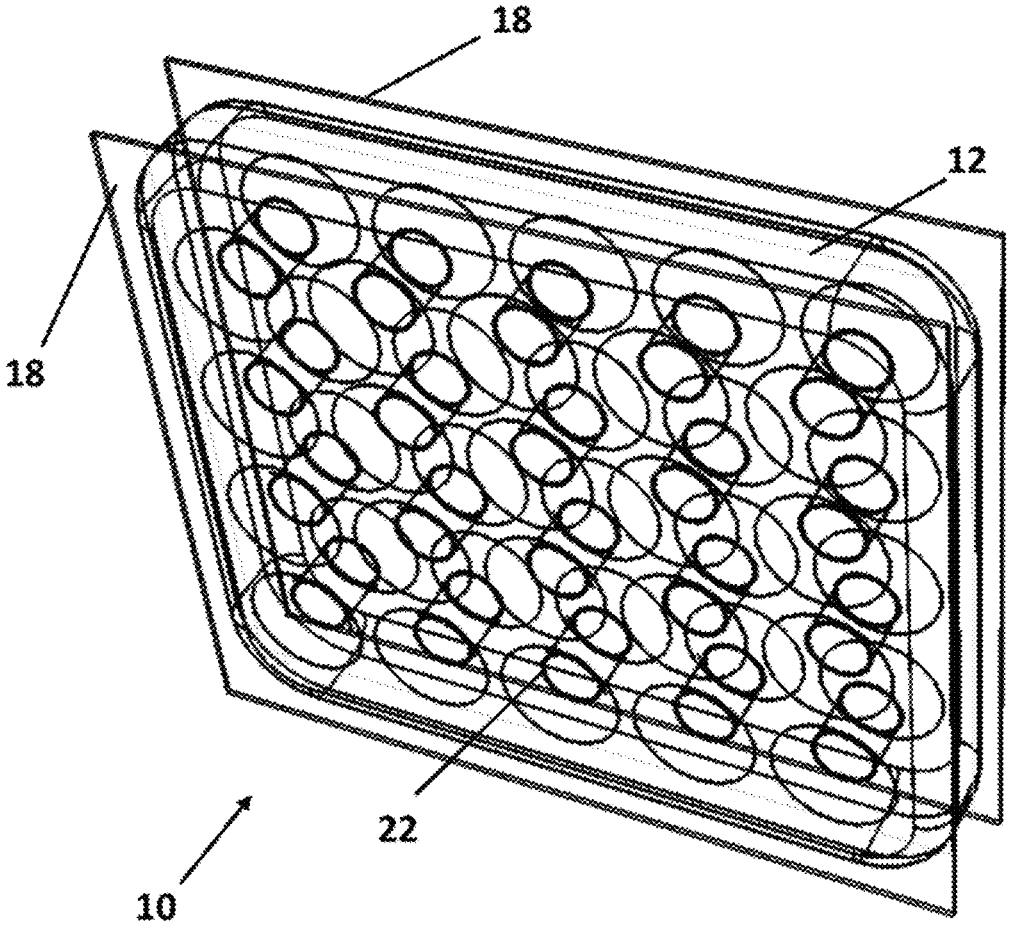
FIG. 1F is a perspective view of an inflated Sound Attenuation Core+SAM Barrier+two layers of SAM according to one embodiment.
Figure 1G:
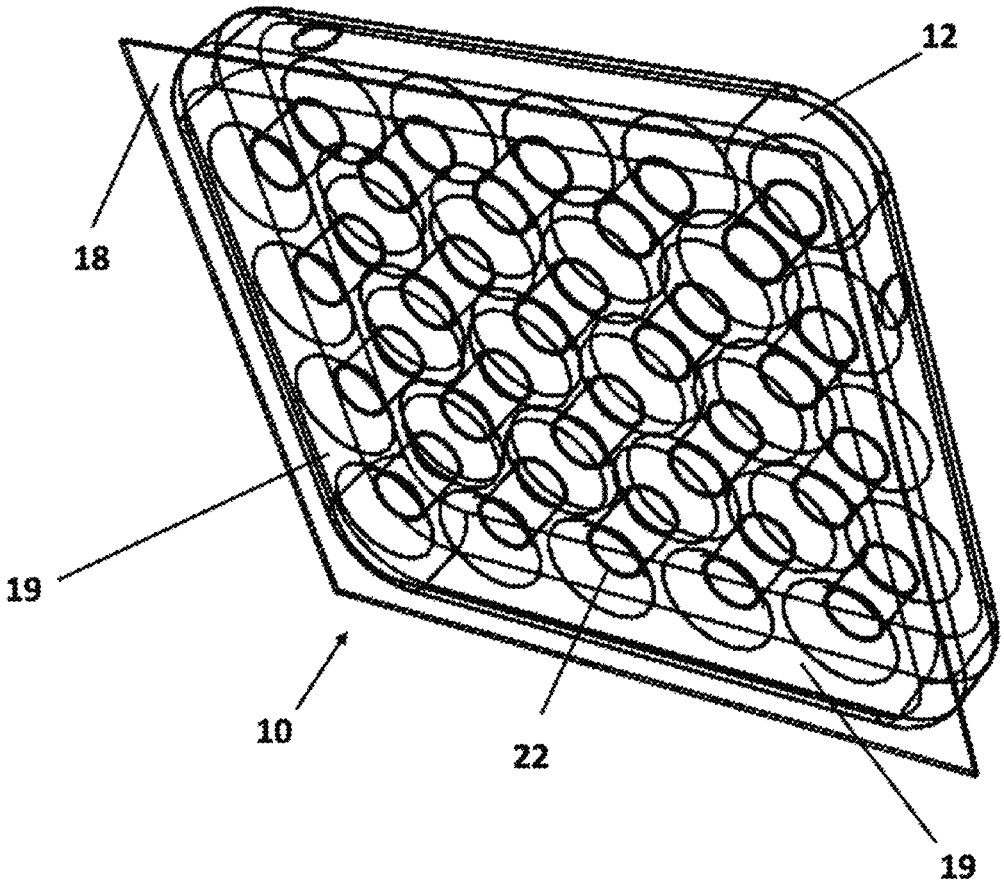
FIG. 1G is a perspective view of a Sound Attenuation Core+SAM Barrier+one layer of SAM according to one embodiment.

In another embodiment, two inflatable cores can be combined for extra increased soundproofing as illustrated in FIG. 1D. Even when combining at least two inflatable cores between three innovative frames, with or without at least one, at least two, at least three and at least four or more SAMs affixed to one or more barrier surfaces of one or more of the two cores, the compressed thickness can be still less than 2" making shipping, carbon footprint and assembly as easy and affordable as a sound attenuation panel of FIG. 1C.

Panel 10 or panel 6 provides advantageous sound attenuation qualities. While not wishing to be bound by any theory, sound attenuation can potentially be achieved by: suppression of sound within a sealed air cavity (or other gases, solids and/or liquids and combinations thereof within the cavity, as discussed below) between the barrier surfaces, the thickness of the cavity, which can be varied to achieve a desired attenuation, the possible contribution of an internal air pressure difference within the inflatable core and the environment within which the core can be inflated, and also when combined with a sound attenuation material layer(s). A single layer of SAM on only one barrier surface can have reduced sound attenuation properties versus at least one SAM layer on each barrier surface. Sound waves impinging on the barrier surface can be significantly attenuated not only by the SAM layer (e.g., MLV), but possibly also by the pressurized air cavity between the barrier surfaces 19 of chamber 12 or chamber 7, and perhaps by the diaphragmatic absorption effect previously mentioned.

SAM can be of a variety of materials and can be available from a wide selection of vendors. Examples of SAM or added to a SAM sheet or layer include but are not limited to: MLV (mass loaded vinyl), High Mass/High Density PVC, lead, barium salts, silica or other heavy metal-impregnated materials such as fabrics or plastics, and other flexible or rigid materials, fabrics and plastics. MLV can be a commercially available material, and can be obtained in different thicknesses and in different opacities (e.g., opaque, transparent and translucent), SONEX® Acoustic Foams, Auralex Studio Foams, Sealed Air Corp Waterproof Foams: Stratocell and Ethafoam, Unika Vaev Sound Absorbing Panels, such as the Ecoustic line, SnowSound Noise Absorbing Panels such as the Mitesco line, CFAB™ cellulose panels ('green' sound absorbing foam), melamine foam and polyurethane foam, Felts of various thickness, Other Fabrics, such as Terrastrand® fabric (Chilewich® Sultan LLC, New York, N.Y.), fiberglass, quilted fiberglass absorbers, polyester acoustical panels, LEAD (such as Acousti-Lead sheets), AlphaSorb Barrier, Quiet Rock (drywall), SoundBreak Gypsum Board, and Glass. In one aspect it can be noted that an inflatable core can be surrounded by or placed between one or more SAM sheets or layers in addition to or in place of MLV.

As is known to one of skill in the art sound barriers (attenuators) can be both dense and flexible. Depending on the material comprising the sound barrier and the sound transmission class (STC) of acoustical material, greater attenuation can be achieved with increased thickness and density of the material as applied. However, with increased density and thickness the issue of rigidity can in some instances negate the effectiveness of the density. Common soundproofing materials and the thickness required to achieve varying levels of soundproofing are listed in the sound barrier chart of FIG. 11.

Material below the stepped line have sufficient pliability such that their weight can be used efficiently for soundproofing while materials above the line lack adequate pliability such that their weight exceeds effectiveness as a desired soundproofing material. It is noted that the claimed sound attenuation core starts at a compressed thickness of one inch and can be used at a thickness of up to 4.5 inches, up to 10 inches, up to 18 inches, or greater.

Figure 2A:
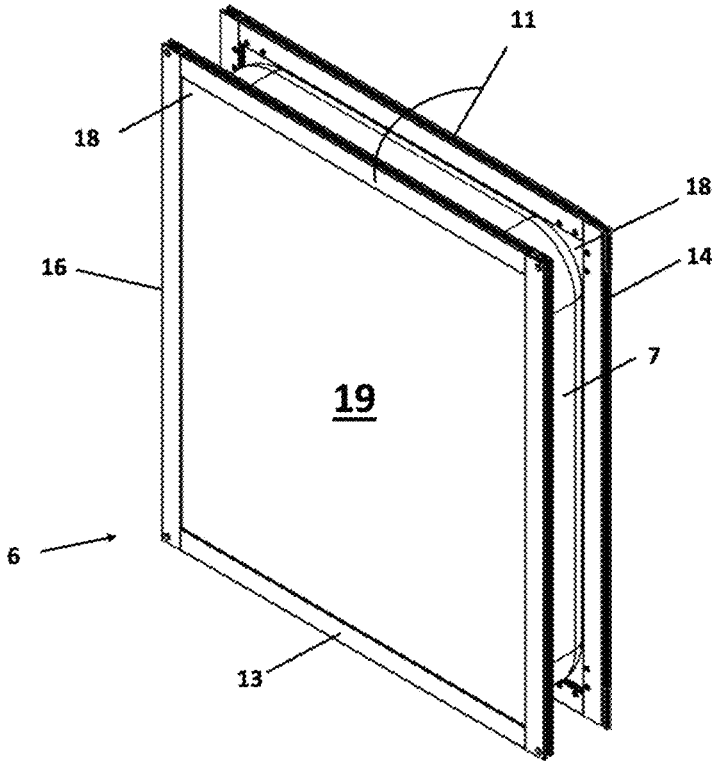
FIG. 2A is a perspective view of an inflated sound attenuation panel with an opaque sound attenuation material on both external (predominant) barrier surfaces of the inflated Structural ISAT Panel according to one embodiment.
Figure 2B:
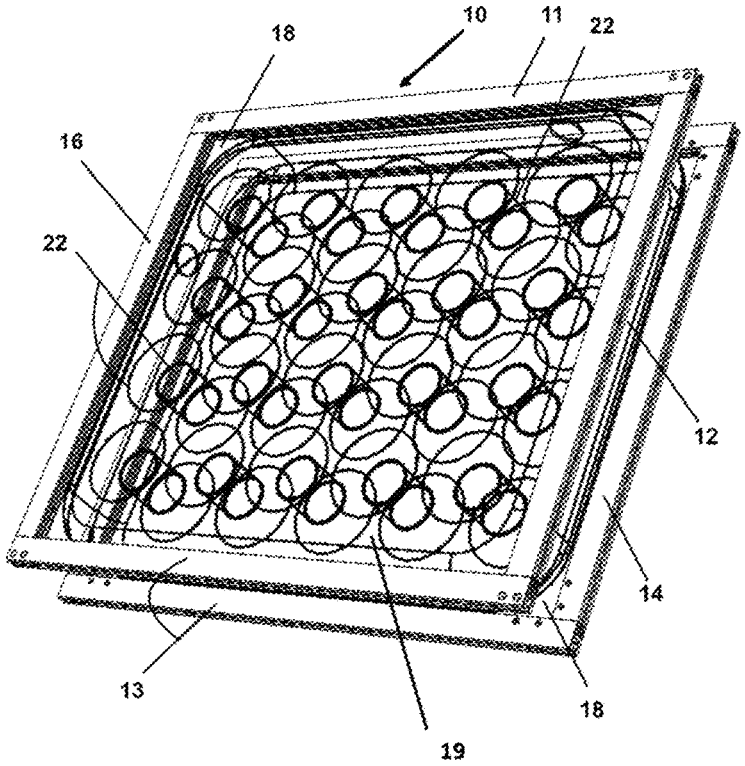
FIG. 2B is a perspective view an inflated Structural ISAT Panel with internal sound baffles within the inflatable core and a transparent sound attenuation material on both external (predominant) barrier surfaces of the inflated Structural ISAT Panel according to one embodiment.

FIG. 2A is a perspective view of the panel 6 of FIG. 1B in an inflated state with an opaque sound attenuation material 18 on both barrier surfaces 19 of the inflated chamber 7. As shown, one barrier surface includes an opaque or translucent or transparent layer of sound attenuation material 18 attached thereto, and the other barrier surface also includes an opaque or translucent layer of sound attenuation material 18 attached thereto. In one alternate embodiment, only one barrier surface can have a layer of sound attenuation material attached thereto. In one embodiment, the sound attenuation material includes clear mass-loaded vinyl (MLV), however, other materials with useful sound attenuation characteristics can be used. As illustrated in FIG. 2B, the perspective view of inflated sound attenuation panel 10 can have a transparent layer of sound attenuation material 18 on both barrier surfaces 19 of the inflated core 12 having a plurality of internal sound baffles 22.

Where only one barrier surface includes a sound attenuation material attached thereto, the sound attenuation properties can reduced when compared with the use of two SAM layers. Also, it should be appreciated that the thickness(es) of the sound attenuation layer(s) (e.g., MLV) can be varied, and that the thickness of cores 6 and 12, when inflated, can be varied to optimize sound attenuation. For example, in certain situations, depending in part on the materials used and the frequencies to be attenuated, it can be desirable to have a core thickness (inflated) of about 3", of about 4", of about 5" and of about 6", and in other situations it can be desirable that the thickness be about 7", about 8", about 9", about 10" or greater. In general the inflatable core thickness can be configured to be between about 1" and about 10" or more. In addition two inflatable sound attenuation panels can be combined as in FIG. 1D to provided increased sound attenuation. Also, the thickness of the sound attenuation material sheets or layers (e.g., MLV) can be between about 1 and 2 mm and about 1 or 2 inches or more. For example, larger thickness sheets can be desirable for large-scale sound attenuation systems such as might be used in an aircraft hangar or other industrial setting. Also, flexible materials can be preferred due to better sound attenuation and/or absorption qualities of flexible material; sound waves typically have more trouble consistently penetrating materials having a lower stiffness and/or greater flexibility. Additionally, it can be possible to have different thicknesses of SAM on each opposite barrier surface. The variation in SAM thickness on opposite barrier surfaces can help provide improved soundproofing performance. To illustrate, a first barrier surface can have MLV weighing 1 lb. per square foot and the second barrier surface can have MLV weighing about ½ lb. per square foot.

As used herein, the term "about" can refer to plus or minus 4 oz. when considering SAM weights.

In one aspect, one of skill in the art can appreciate that there can be at least two, at least three and at least four or more intra-chambers within inflatable cores 6 and 12. Each intra-chamber(s) can be filled with different gases, solids or liquids, including but not limited, to air, helium, neon, argon, water, mineral oil, vegetable oils such as cottonseed oil and rapeseed oil, sand, and so on.

Re-Enforced Inflatable Core Frame

As shown in FIG. 3A, in one embodiment, the innovative extruded straight metal or polymer tube 55 shown in cross section can be used for framing the inflatable cores 6 and 12. The frame has a common transverse horizontal top wall 58 shown in profile defining interconnection means in the form of channels such as a longitudinal central interconnecting channel 52 and lower longitudinal interconnecting channels 53 and 54. It also defines a longitudinal upper recessed groove 56 extending above a transverse horizontal top wall 58 thereof. The lower longitudinal interconnecting channels 53 and 54 suggest angular C-shaped parallel channels defining a central transverse horizontal wall 57. The opposed, interconnecting channels 53 and 54 permit SAM edges to be received and secured (e.g. in 53) and/or a coupling device(s) inserted into channel 54 to secure a sound attenuation panel having frame 55 to a floor mounting bracket. Transverse walls 57 and 58 provide strength and support to frame 55, as do the internal projections into longitudinal central interconnecting channel 52. FIG. 3B provides a longitudinal view of FIG. 3A in one embodiment further illustrating recessed holes 49 at either end of the extruded frame (cut to length) for joining the vertical side 16 and 14 (only one shown) and top 11 (not shown) frame pieces at approximately a 90 degree angle with a right angle bracket 3 as shown in FIG. 4A.

Figure 4A:
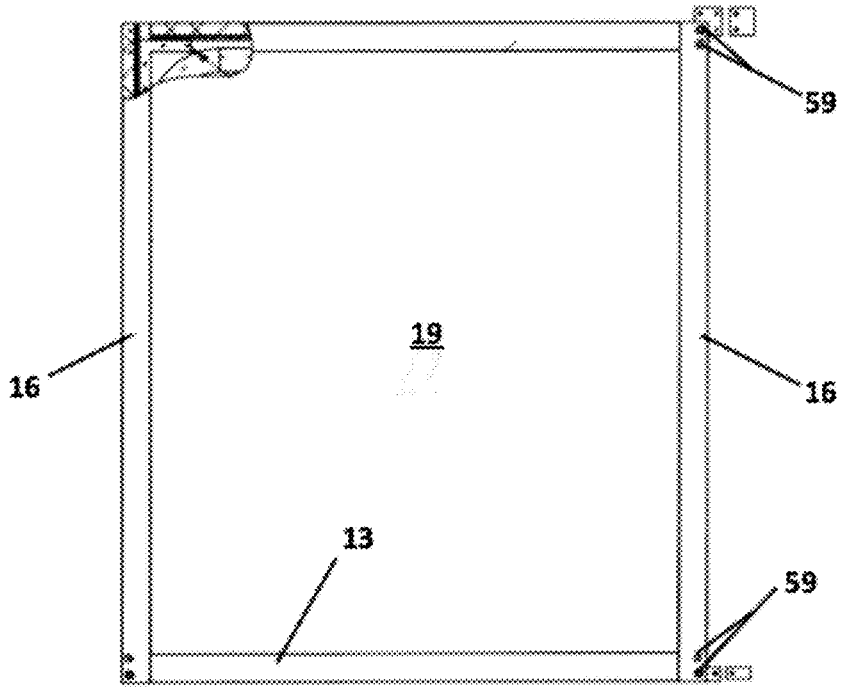
FIG. 4A illustrates a cut-out view through a frame and a sheet of SAM attached to the predominant barrier surface of a sound attenuation panel with an interior view of the Structural ISAT Panel's inner frame and inflatable core and illustrating the right-angle bracket joining two frame pieces, one being the frame of FIG. 3B (vertical frame piece) to assemble each corner of the frame shown in FIG. 2A.
Figure 4B:
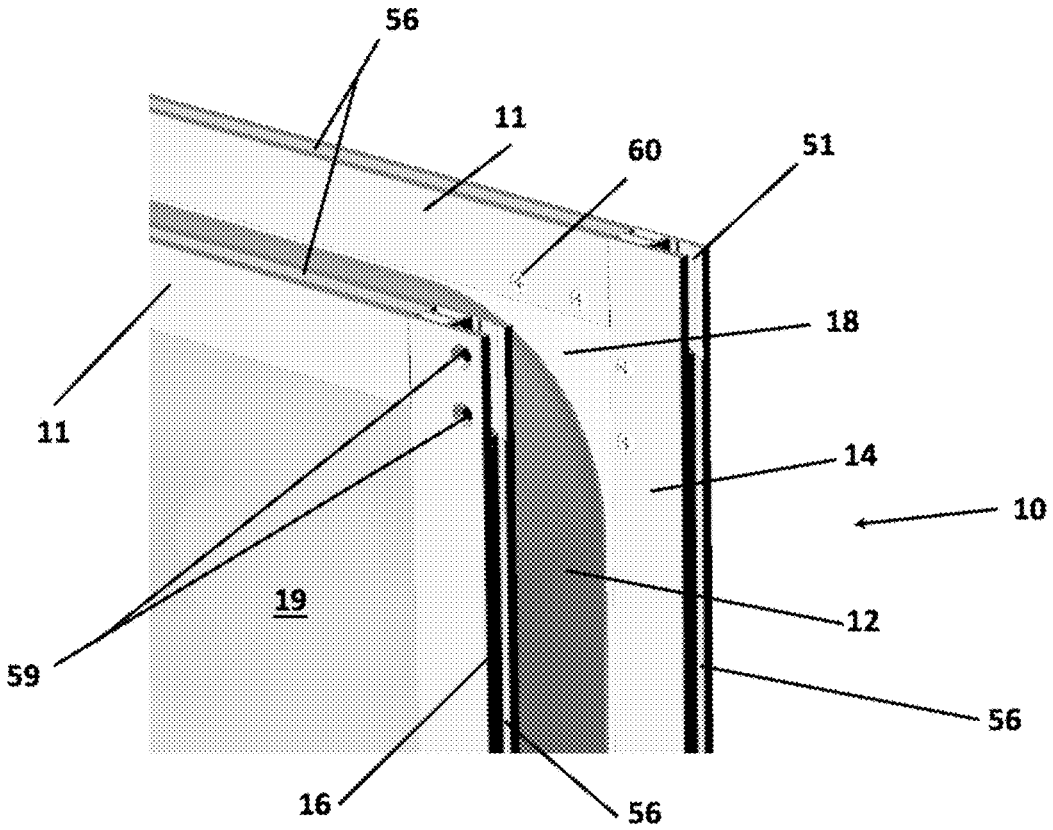
FIG. 4B is perspective view an inflated Structural ISAT Panel as seen from the opposite side of the interior view of FIG. 4A; Showing two frames with SAM attached to each frame and affixed to the inflatable core.

The assembly of the frame for a panel 10 is illustrated in FIG. 4A. A right angle bracket 3 joins each corner of a panel at 90 degrees with a screw 60 (not shown) inserted and screwed into hole 59 and into bracket 3 to the join horizontal 11 top and 17 bottom frames for attachment to vertical frame sides exterior 16 and interior 14. FIG. 4B illustrates a perspective view of the assembled horizontal and vertical frame members in a finished sound attenuation panel 10. The screws that go into the holes both hold the perpendicular, frame pieces together, but they can also hold the SAM, including but not limited to MLV within the channel. The SAM can be further held by the use of a glue, caulk or other bonding agent.

A variety of connecting brackets can be used with the frame of FIG. 4B for assembly of panels comprising frame members. Brackets have been designed to fit into notch 51 as shown in the frames of FIGS. 3B and 4B. The notches are able to receive a connecting bracket for joining two adjacent panels' frames, each frame surrounding the perimeter of a predominant surface, also referred to as a barrier surface for cuboidal panels used to construct a sound attenuation panel. The rectangular tube/frame can be extruded from a metal such as aluminum, or an aluminum alloy, or a polymer, such as polyvinyl chloride (PVC), carbon fiber or another plastic material, including but not limited to polycarbonate.

Figure 5A:
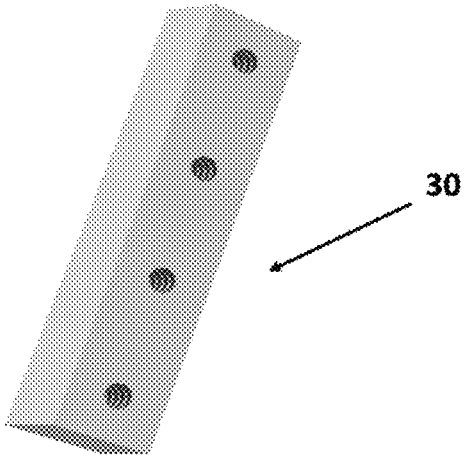
FIG. 5A is a perspective view of one embodiment of a connecting bracket to join vertically or horizontally two outer frame edges of two sound attenuation panels either stacked atop one another or positioned adjacent and where the outer edges of the two frames corners meet and constructed from e.g., the frame of FIG. 3B.
Figure 5B:
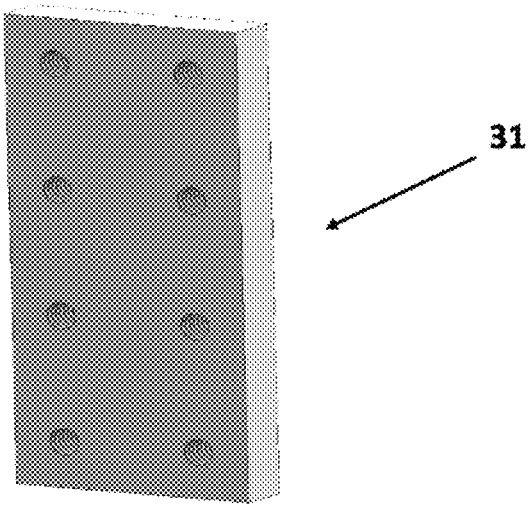
FIG. 5B is a perspective view of an embodiment of a connecting bracket to join four Structural ISAT Panels, e.g., of FIG. 2A where the corners of the four panels meet or where the corners of four panels e.g., of FIG. 4B meet and constructed from the innovative extruded frame of FIG. 3A as illustrated in FIG. 4B.
Figure 5C:
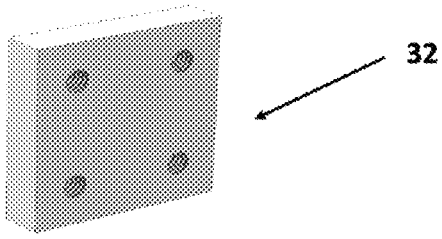
FIG. 5C is a perspective view of one embodiment of a connecting bracket to join two Structural ISAT Panel e.g., FIG. 4B, where the edges of the frames meet at the outer frame edge of a partition, wall or enclosure or structure using the frame of FIGS. 3A and 3B.
Figure 5D:
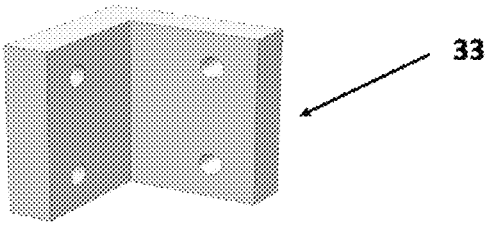
FIG. 5D is a perspective view of one embodiment of a coupling bracket to join two Structural ISAT Panels, e.g., FIG. 4B, to create an approximately 90 degree angles where the edge of one frame meets the frame edge of the other panel at the top or bottom of a panel within a partition, wall, enclosure or structure using the frame of FIG. 3B or FIG. 4B.
Figure 5E:
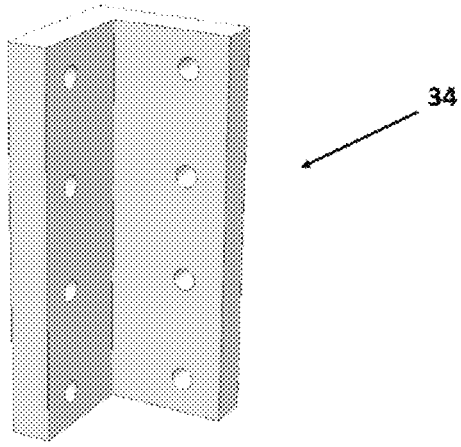
FIG. 5E is a perspective view of one embodiment of a connecting bracket to join four Structural ISAT Panels, two sound attenuation panels stacked atop one another at an approximately 90 degree angles to two other sound attenuation panels stacked atop one another where the edges of the frames meet using the frame of FIG. 3B or FIG. 4B.
Figure 5F:
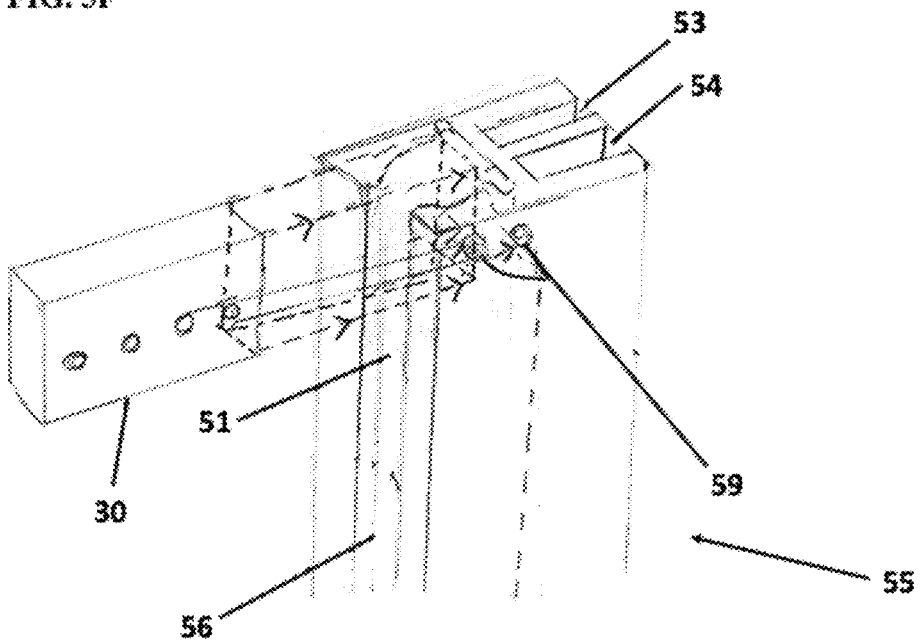
FIG. 5F is a perspective view of the outer edge of a Structural ISAT Panel having the frame illustrated in FIG. 3B at the outer edge of a partition or wall or chamber receiving the connecting bracket of FIG. 5A to join a Structural ISAT Panel adjacent to the first Structural ISAT Panel according to one embodiment.
Figure 5G:
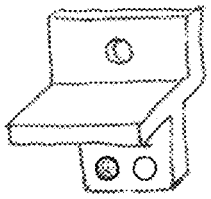
FIG. 5G is a perspective view of one embodiment of a right-sided mounting bracket for use in attaching an outer edge of a Structural ISAT Panel having the frame illustrated in FIG. 3B to a floor, wall, surface or ceiling according to one embodiment.
Figure 5H:
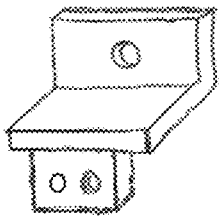
FIG. 5H is a perspective view of one embodiment of a left-sided mounting bracket for use in attaching an outer edge of a Structural ISAT Panel having the frame illustrated in FIG. 3B to a floor, wall, surface or ceiling according to one embodiment.

FIGS. 5A, 5B, 5C, 5D, 5E, 5F, 5G are illustrations of brackets for joining end panels, FIG. 5A, using bracket 30 for two panels stacked atop one another, as for a wall or partition; bracket 31 for joining four panels where the corners of the four panels meet FIG. 5B; bracket 32 for joining two top or bottom adjacent panels, FIG. 5C; bracket 33 for joining two top or bottom adjacent panels at right angles to one another, FIG. 5D; and bracket 34 for joining four panels where the corners of the four panels meet at right angles to one another, FIG. 5E. FIG. 5F illustrates the placement of the bracket 30 of FIG. 5A into notch 51 of innovative extruded frame 55 at the front frame. Similar attachment can be also done to connect the opposite frame of the panel. Four screws, two per front panel frame and two per opposite/back panel frame, are used to attach the two brackets to each of the frame's front and back and four more screws are used to join an adjacent panel frame similarly attached to bracket 30. This variety of brackets and assembly configuration options provides the user with a virtually unlimited selection of wall, partition, cubicle and chamber configurations. This modularity and inter-connectability of the sound attenuation/ISAT panels, regardless of dimension or size, offers the panels to be used in a variety of applications, settings, uses as discussed below. The size, thickness and weight of the panel has been optimized to achieve effective and efficient sound attenuation, isolation, blocking and containment, as well as portability, ship-ability and easy of deployment. FIGS. 5G and 5H are perspective views of a novel bracket design to secure a sound attenuation wall to an existing wall on the right and left sides of the assembled panels, respectively.

Figure 5I:
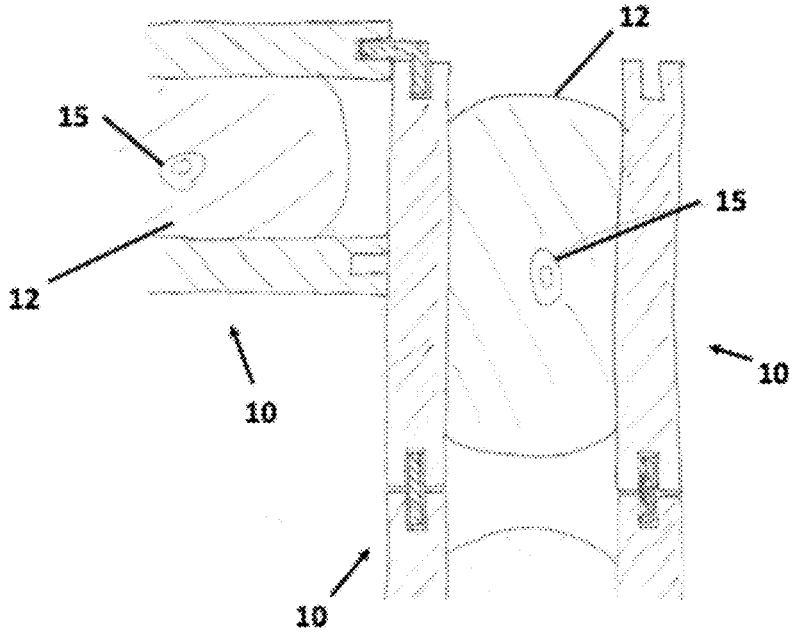
FIG. 5I is an over-head view illustrating three inflated panels connected together. Two panels form a right angle when joined and two panels are adjacent to one another.
Figure 6A:
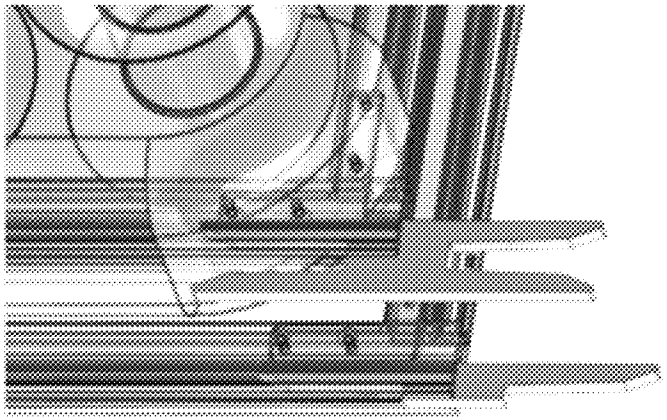
FIG. 6A illustrates a perspective view of two different mechanically-free (i.e. no screws are needed) connecting brackets to join Structural ISAT Panels in one embodiment.
Figure 6B:
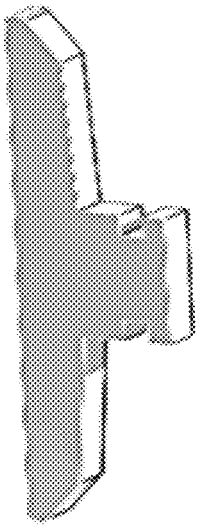
FIG. 6B illustrates a perspective view of a mechanically-free connecting brackets to join two Structural ISAT Panels at an outer edge in one embodiment.
Figure 6C:
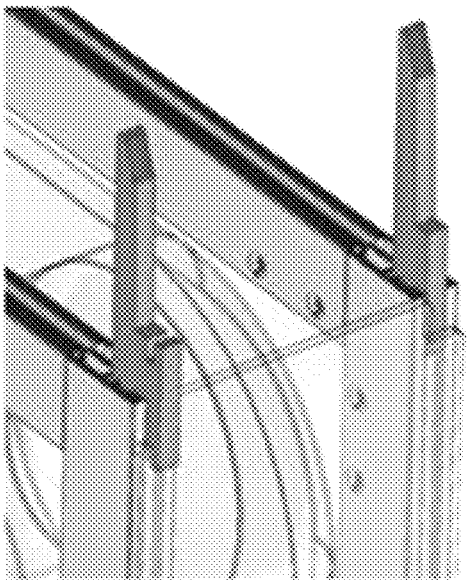
FIG. 6C illustrates a perspective view of one of the mechanically-free connecting brackets of FIG. 6A to join Structural ISAT Panels in one embodiment.
Figure 6D:
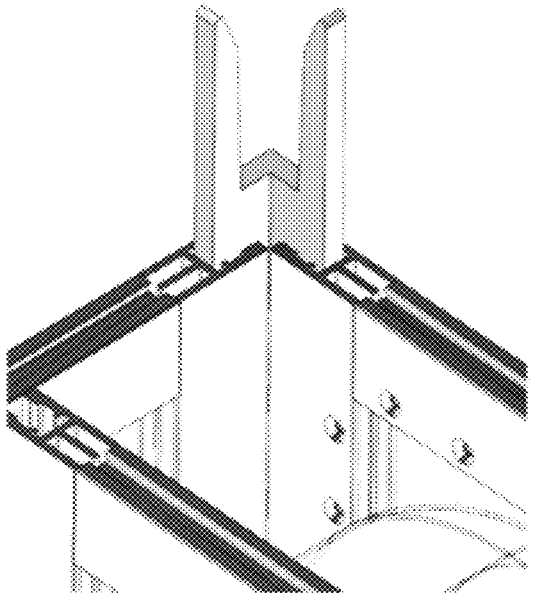
FIG. 6D illustrates a perspective view of a mechanically-free connecting bracket to join four Structural ISAT Panels to two sound attenuation panels stacked atop one another to join two attenuation panels stacked atop one another at an approximately 90 degree angle to two additional attenuation panels stacked atop one another an outer edge in one embodiment.
Figure 6E:
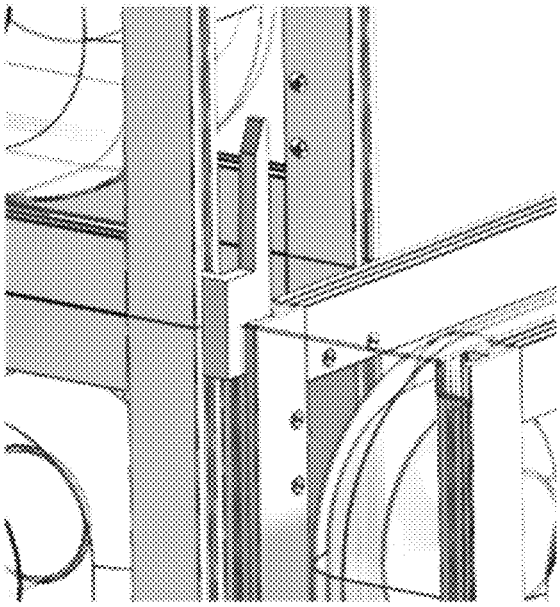
FIG. 6E illustrates a perspective view of a mechanically free connecting bracket to join four Structural ISAT Panels as illustrated in FIG. 6D, showing three panels inter-connected.

Brackets 31 as well as 30 and 32 can be used to join four and two adjacent panels, respectively, when placed in notch 51 of frames 3B and 4B. Additionally, brackets 33 and 34 can be used to form aright angle and attach either two or four panels at 90 degrees, respectively, when placed in notch 51 of frames 3B and 4B. When forming a 90-degree angle there can be two or four screws per panel into each bracket depending on the frame used. FIG. 5I illustrates three panels connected together. Two panels form a right angle when joined and two panels are adjacent to one another. Possible brackets used to connect the panels include the right angle brackets illustrated in FIGS. 5D and 5E. Connecting brackets for adjacent panels are illustrated in FIGS. 5A, 5B, and 5C. Other connecting brackets having 1,2,3, or 4 screws per panel are also envisioned.

According to one embodiment, an acoustic barrier structure includes one or a plurality of connected panels 6 or 10. For example, a single panel can be positioned appropriately to provide a sound barrier, e.g., between rooms, or against a wall, floor, ceiling, etc. Also, multiple panels can be positioned and configured to provide an enlarged barrier, an enclosed or partially enclosed chamber, or to reinforce sound attenuation or the retrofitting of an existing wall. In one aspect, one or multiple panels 6 or 10 are held together using a variety of connecting devices as discussed above. In another embodiment the arrangement, shape or shapes of the internal sound baffles 22 can be not only for assisting in sound attenuation but to provide esthetic, artistic, setting specific features or corporate branding. In one aspect, the internal sound baffles can be arranged such that when inflated the shape or design of a corporate brand or logo can be visible in the inflated internal sound baffles while retaining the benefits of the inflatable sound chamber with internal sound baffles, as described previously.

In one embodiment, the baffle inside the inflatable chamber, can be concentric, and can provide the benefit of concentrating some of the acoustic energy being attenuated, absorbed, and/or diffused by the combination of the barrier layer(s) and their respective thicknesses, the pressurized air inside the chamber, and the shape and length of the baffle(s), in a manner similar to a baffle inside a muffler for a car, a speaker cone, or a silencer for a rifle. In another embodiment, the baffle can have additional materials layers, forming larger and smaller 'funnel rings' for the sound waves to travel through and can provide additional enhanced sound wave attenuation, absorption and diffusion performance. In another embodiment, baffles can be equipped with chambers that can contain liquid, solids or gasses other than air to provide additional attenuation, absorption and diffusion performance.

The number of baffles in the construction of each panel can enhance the ability of the both a Structural and a Non-Structural ISAT panel to act as an inflatable diaphragmatic absorber. In one embodiment, 20 baffles, which can act as individual 'shock absorbers' or 'inner mattress springs' can allow the SAM barrier(s) to flex upward and downward and/or backwards and forward when sound wave energy strikes the barrier layer(s), on either the entry or the exit side of the panel. The shape, length and girth of the baffles, can be one of the determining factors for the thickness of the overall panel and can allow for the placement of more or fewer baffles in each individual Structural or Non-Structural ISAT panel.

Figure 7A:
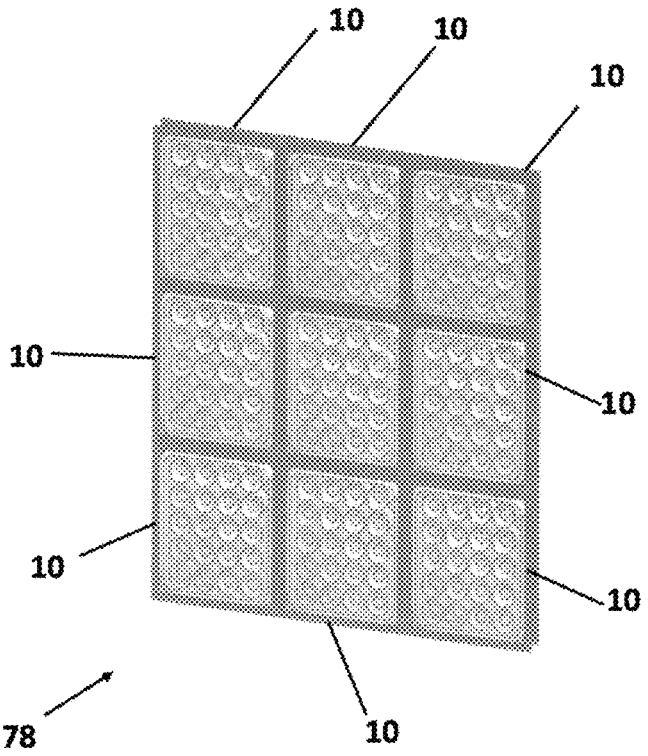
FIG. 7A is a perspective view of the assembly of nine inflated sound attenuation panels according to one embodiment.

FIG. 7A illustrates an example of a sound attenuation wall 78 a wall of nine panels 10, coupled together with a plurality of connecting devices. As shown, wall 78 includes multiple panels 10, each having an opaque SAM layer(s) (e.g., MLV) so that the wall also provides a visual barrier. It should be appreciated that any or all panels could be fabricated of transparent or translucent materials to provide a "see-through" wall. As discussed above, the panels 10 can be connected together using a variety of connecting devices. In certain aspects, the frame, having longitudinal grooves or channels can further include either a strip of SAM or a gasket spanning the depth and inserted into adjoining grooves 56 or channels 65.

Figure 7B:
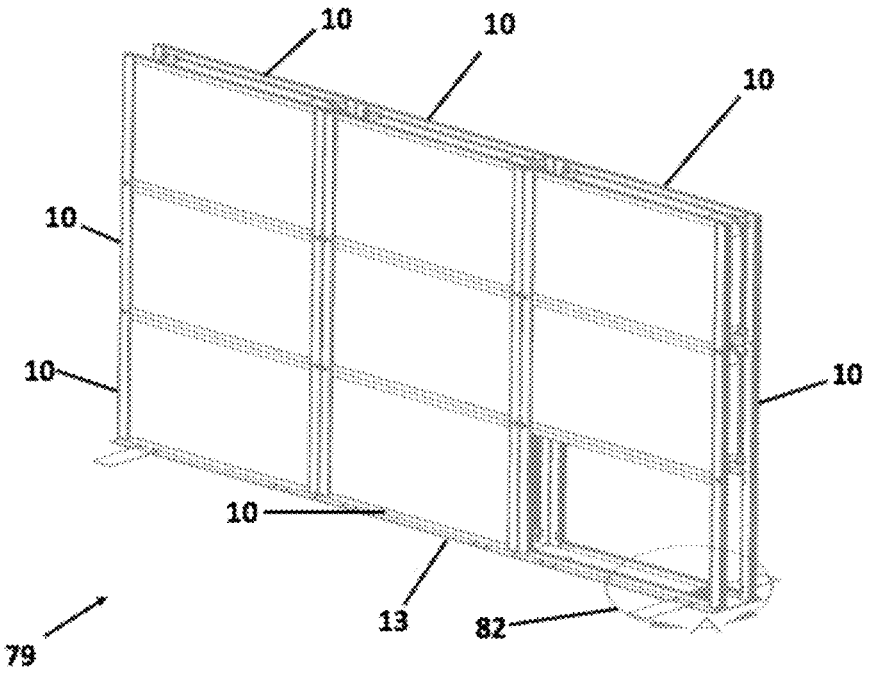
FIG. 7B is a perspective view of a sound attenuation wall built from the assembly of nine inflated sound attenuation panels (one inflated SAM-augmented inflatable insert—i.e. inflatable core+tow layers of SAM—not shown) in which the frame of FIG. 3B was used for framing the sound attenuation panels according to one embodiment.
Figure 7C:
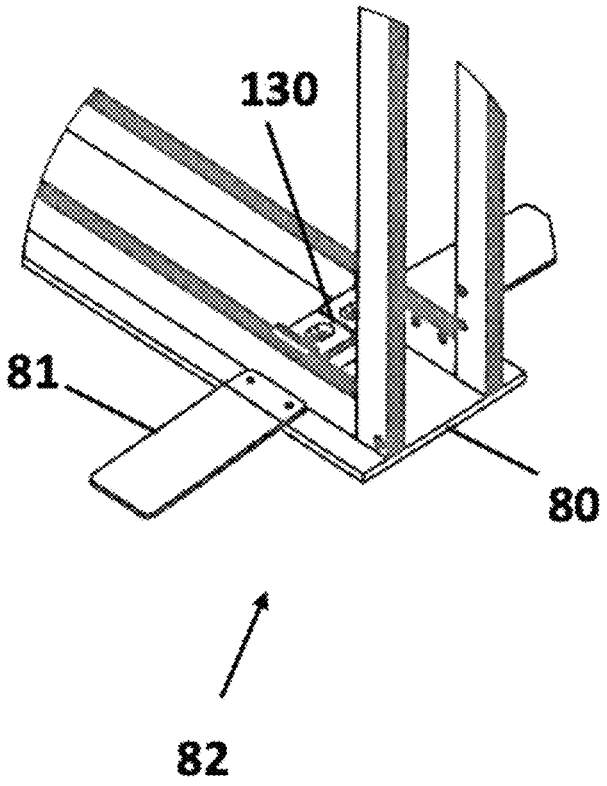
FIG. 7C is a magnified perspective view from FIG. 7B of the base/floor plate, stability floor support and the integrated panel holder.

FIG. 7B is a perspective view of a freestanding sound attenuation partition 79 built from the assembly of nine inflated sound attenuation panels 10 (one inflated core not shown). The magnified view 82 of the floor plate 80, stability floor support 81 and integrated panel holder 130 is shown in FIG. 7C as constructed with the innovative frame of FIG. 3A. As can be appreciate by one of skill in the art the horizontal frame members are not notched at the ends and the vertical frame members are notched in order to receive the connecting brackets as illustrated in FIGS. 5A, 5B, and 5C for connecting two panels or four panels at their corners.

Figure 8A:
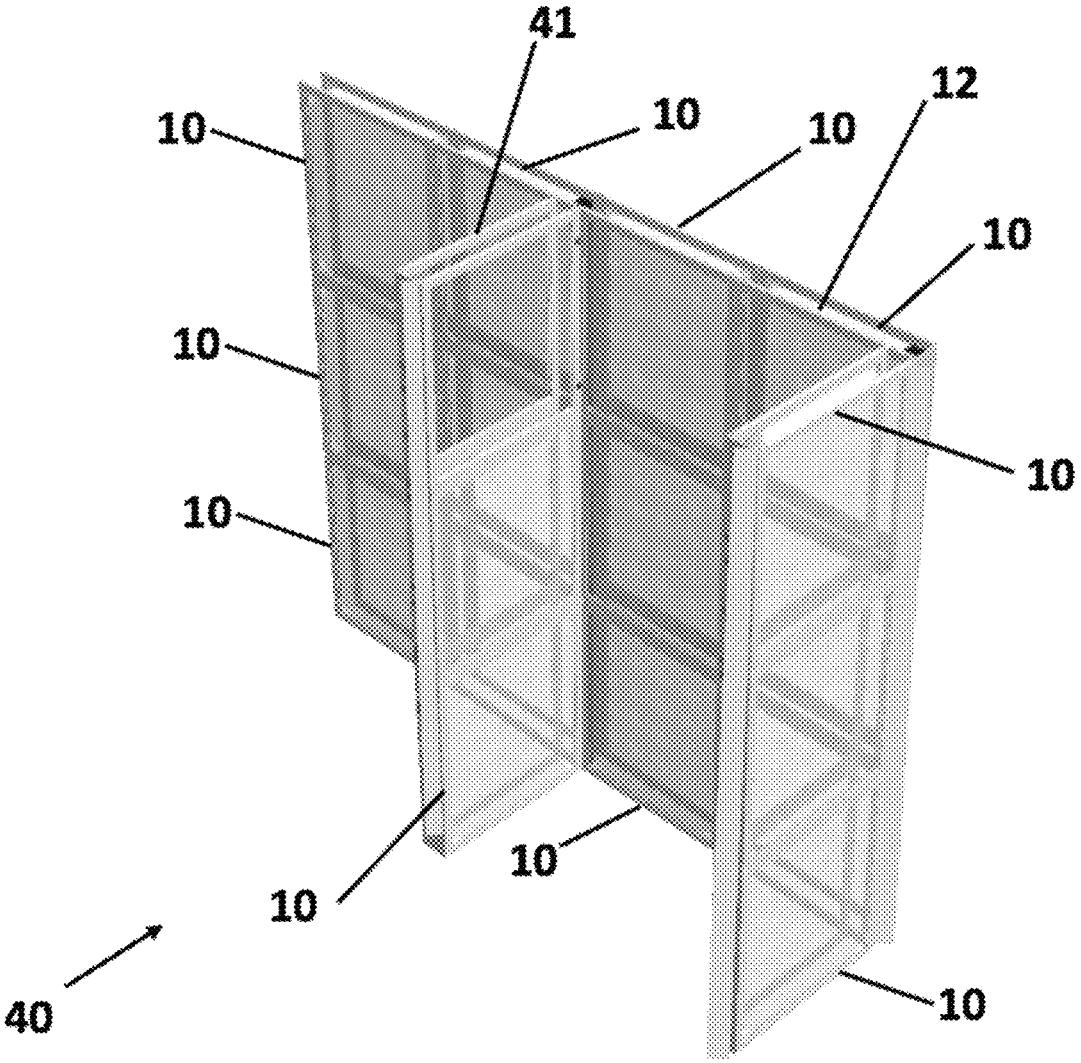
FIG. 8A is a perspective view of 18 sound attenuation panels as depicted in FIG. 2A or 2B and one sound attenuation panel frame without an inflated insert assembled into a free standing wall and separate areas formed with two walls of three panels stacked atop one another and positioned perpendicular to the wall of twelve panels according to one embodiment.
Figure 8B:
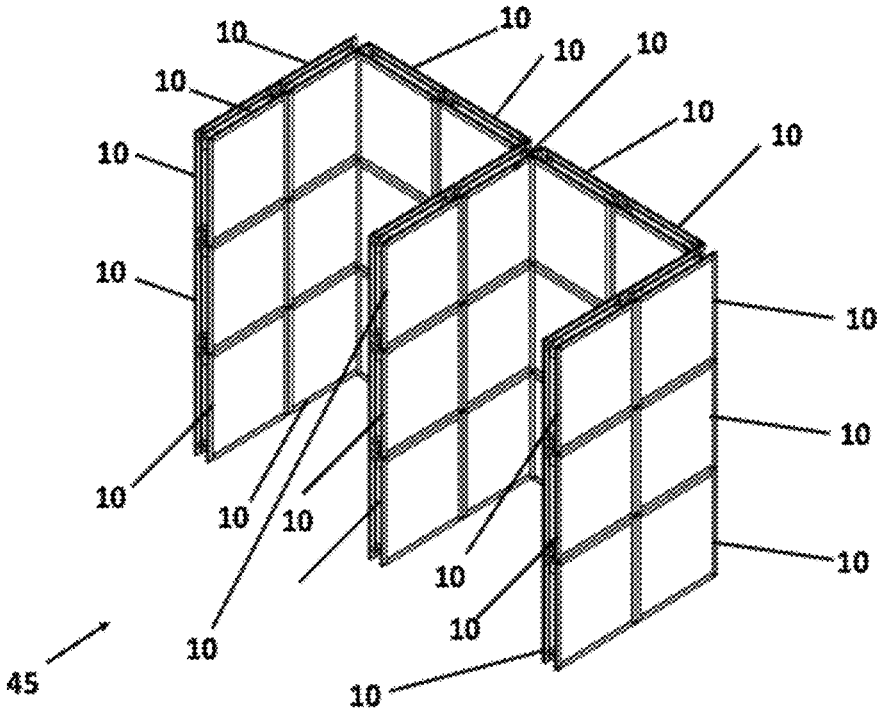
FIG. 8B is a perspective view of 30 sound attenuation panels as depicted in FIG. 2A or 2B assembled into a free standing wall with two separate cubical-like areas according to one embodiment.

FIG. 8A illustrates an example of an acoustic barrier structure including a plurality of panels 10, connected together with a plurality of connecting devices to form partitioned sound attenuation wall 40. As shown, wall 40 includes multiple (18) sound attenuation panels 10, each having transparent or translucent sound attenuation layers (e.g., MLV) so that the wall can be "see-through". It can be further possible to have one panel 41 absent an inflatable core 12. It should be appreciated that any or all panels could have a sound attenuation layer(s) comprising opaque materials, decorator fabrics, etc. to provide esthetics, camouflage, or ease of cleaning, sterilizing, etc. depending on where and how the wall can be utilized. FIG. 8B illustrates another example of an acoustic barrier structure including a plurality of panels 10, connected together with a plurality of connecting devices to form partitioned sound attenuation wall 45. As shown, wall 45 includes multiple (30) panels 10, each having opaque sound attenuation layers (e.g., MLV) so that the cubicles are "private". As shown in FIGS. 8A and 8B, the panels 10 are coupled together using a variety of coupling devices as illustrated in FIGS. 5A-5E, and 5G-5H.

Any framing device can be custom fashioned into a service panel of any desired size and can include portals for ventilation, HVAC system circulation ports and power, and secure IT cabling/internet passages, Audio and/or Visual (A/V) systems, or other features as desired. It should also be appreciated that the configurations of the framing shown can take on different cross-sections and shapes to contain utility cables and wires, provide strength and stability and attachment of SAM. In addition, LED lighting, white boards, work surfaces(s) shelving, etc. can be attached to the assembled panels, partitions, walls, chambers and structures to augment the purpose of the structure.

Figure 9A:
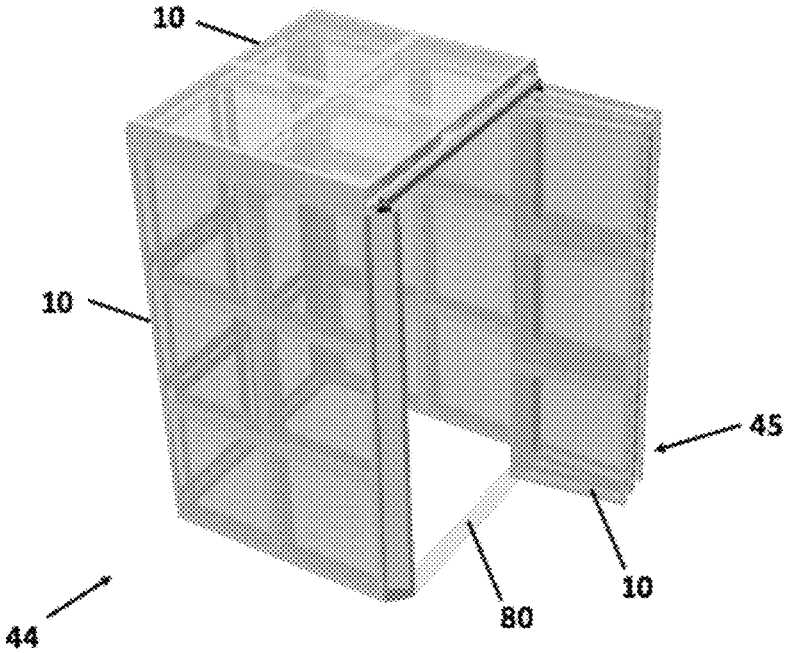
FIG. 9A is a left-sided perspective view of a square acoustic barrier chamber built with 28 sound attenuation panels, 24 panels form the four sides: three sides having six panels each and a fourth side having six panels fashioned into a bi-fold door and an additional four panels forming a ceiling, according to one embodiment.
Figure 9B:
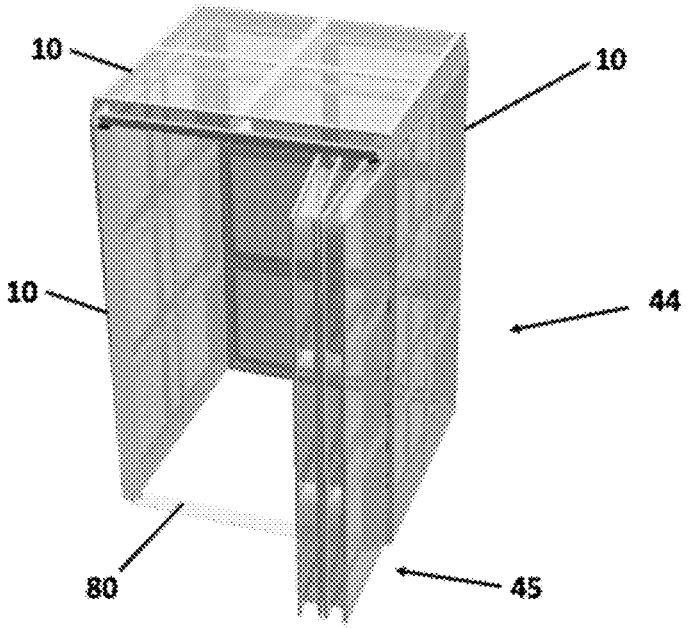
FIG. 9B is a right-sided perspective view of the chamber of FIG. 9A.

As illustrated in FIG. 9A, the panels can be assembled into a booth for use for example, in negotiations at a trade show, a telephone room for private conversation, an individual recording or listening room as well as for playback or recording audio or video content (for later transmission) by digital media means or any space where sound containment, soundproofing or sound blocking is desired. The augmented chamber 44 made with 28 sound attenuation panels 10 illustrates a left perspective view of a transparent chamber and ceiling. The ceiling has four panels, and an exterior modification of one side of the chamber permits the attachment of a bi-fold door 45. As can be understood by the skilled artisan, alternative modifications to the exterior can be made for a sliding, swinging, lift-up or uni-directional opening door. Likewise the frames of the panels that comprise the bi-fold door have door mounting hardware and both hinges and fittings for sliding the door open and closed. The chamber is shown attached to floor plate 80 as illustrated in FIG. 7C, but in FIG. 9A the panels are offset to the outer edge of floor plate 80. FIG. 9B provides another perspective view from the right of chamber 44. The chamber could be of any dimension, but as illustrated can be approximately 48" square and 81" high. In another embodiment, an 'acoustic curtain' door device can be used to provide a door to an enclosure, such as those commercially available from companies such as Residential Acoustics (www.residential-acoustics.com)

Figure 9C:
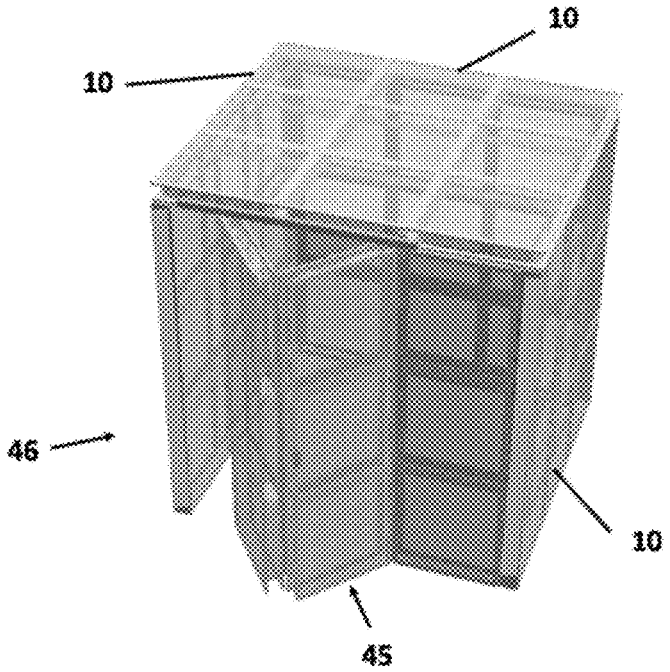
FIG. 9C is a perspective view of a square acoustic barrier chamber built with 45 sound attenuation panels, 36 panels form the four sides: three sides having nine panels each and a fourth side having nine panels, six of the nine panels form a bi-fold door and an additional nine panels forming a ceiling, according to one embodiment.
Figure 9D:
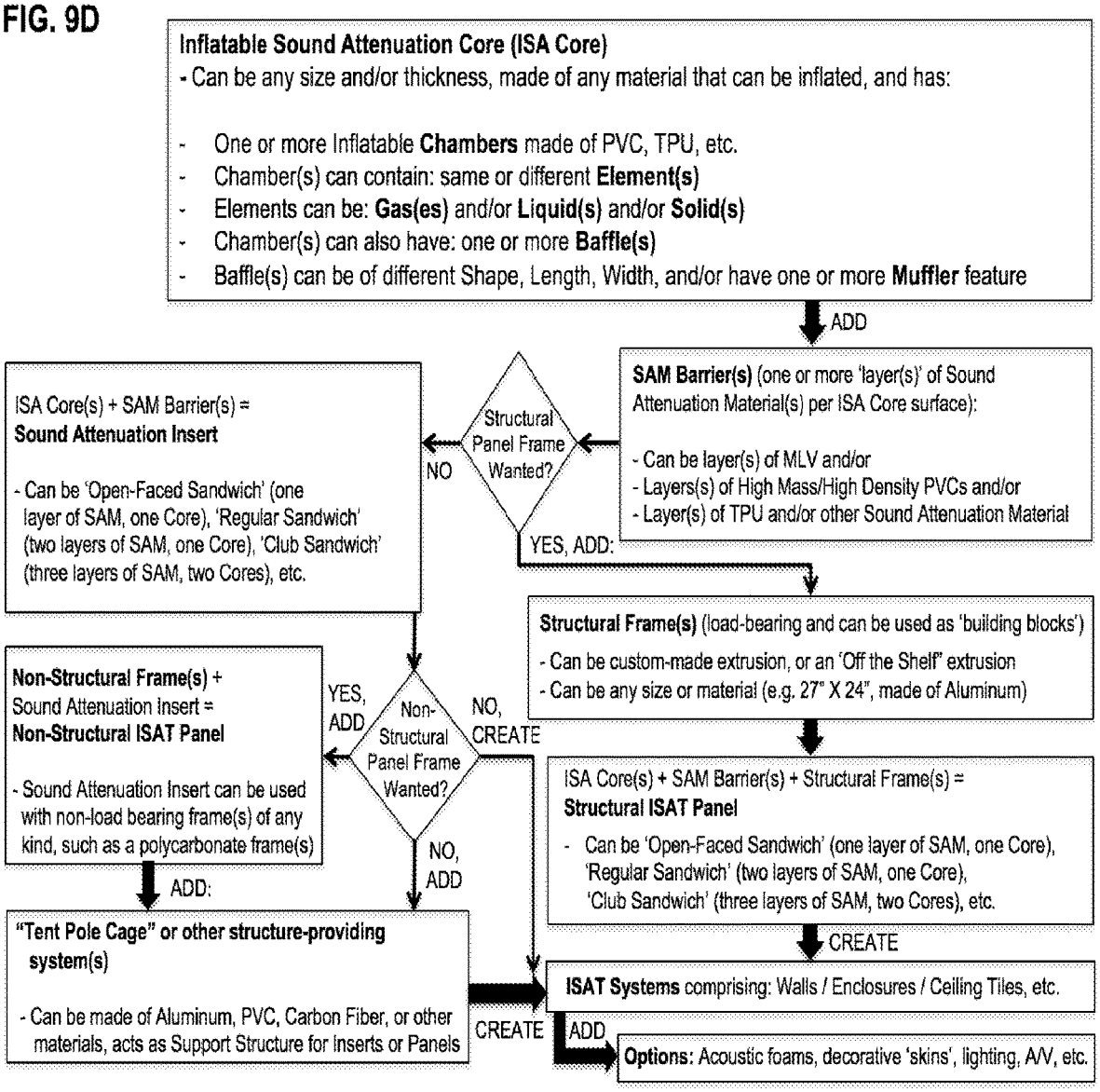
FIG. 9D is a flowchart illustrating some embodiments of the ISAT system.

In one embodiment, it can also be possible to have a larger augmented enclosure 46 for use as an office, conference or meeting room in addition to the uses of the booth of FIGS. 9A-9B, as well as have a significantly larger (e.g., an aircraft hangar) enclosure 46 as illustrated in FIG. 9C. The enclosure 46 of FIG. 9C was assembled using 45 panels 10 of the disclosed invention. The right perspective view of the enclosure 46 illustrated access in and out of the enclosure by a bi-fold door 45. Floor plate 80 is not shown.

Figure 10A:
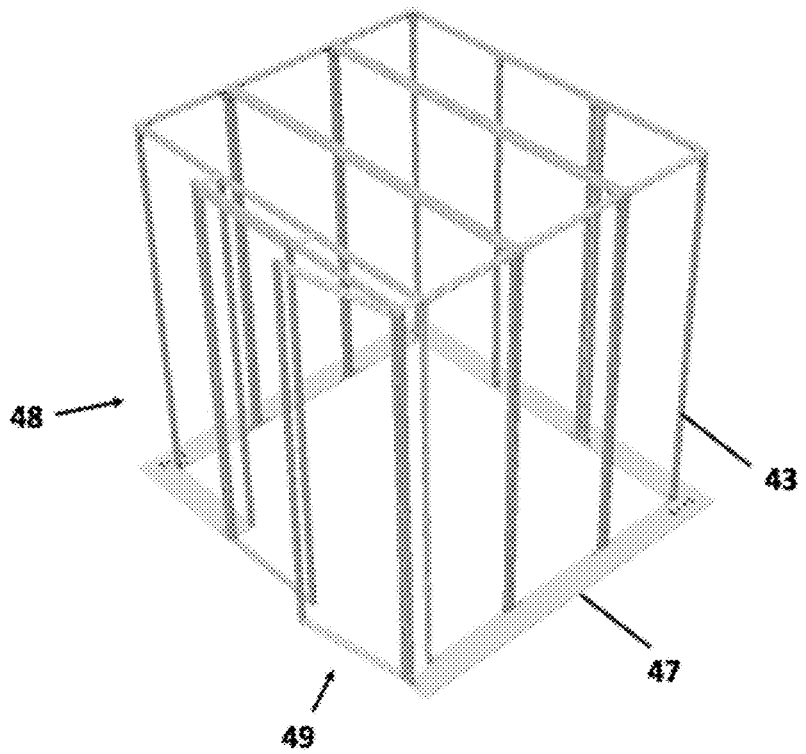
FIG. 10A is a perspective view of a tent pole cage suitable for supporting Non-Structural ISAT Panels that have been made without loadbearing frames, so that an enclosure can still be built of such panels, as the 'tent pole cage provides the structural integrity.
Figure 10B:
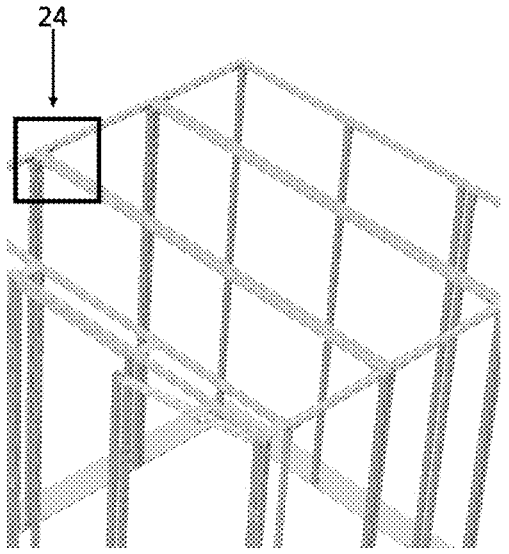
FIG. 10B is a larger perspective view of the cage of FIG. 10A showing the upper framing assembly.
Figure 10C:
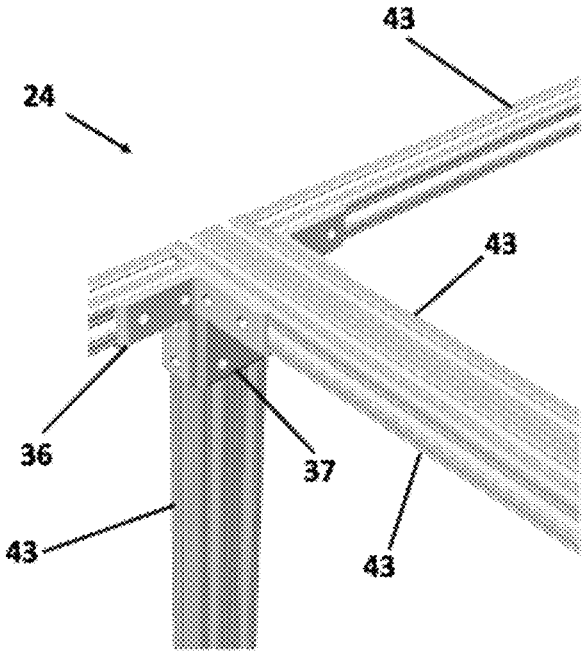
FIG. 10C is a magnified perspective view from FIG. 10B illustrating the assembly of FIGS. 10A and 10B; —Notice that this design allows the panels to fit tightly to the tent pole frame so that a tight seal is maintained between all elements of the structure and system, for providing good soundproofing performance, just one aspect of the overall ISAT system.
Figure 10D:
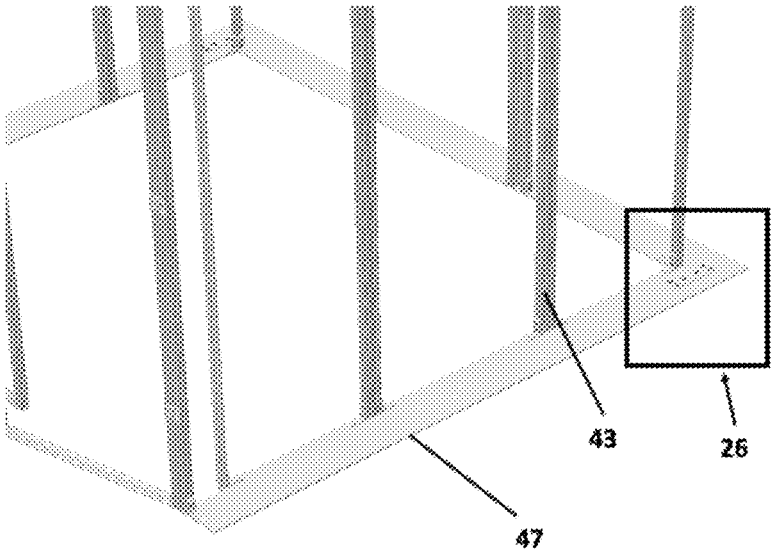
FIG. 10D is a perspective view of the frame members and floor plates of the cage of FIG. 10A.
Figure 10E:
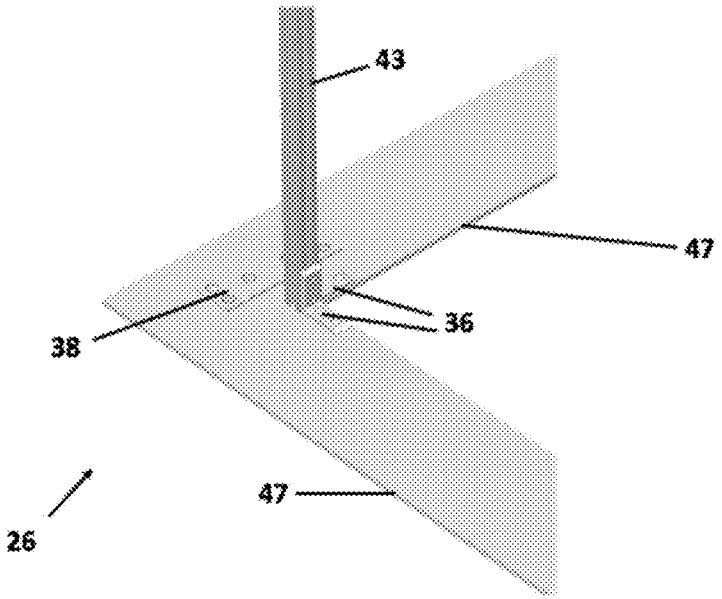
FIG. 10E is a magnified perspective view from FIG. 10D illustrating the attachment of a frame from FIG. 10D to a floor plate using similar coupling devices as illustrated in FIG. 6C, in one embodiment.
Figure 10F:
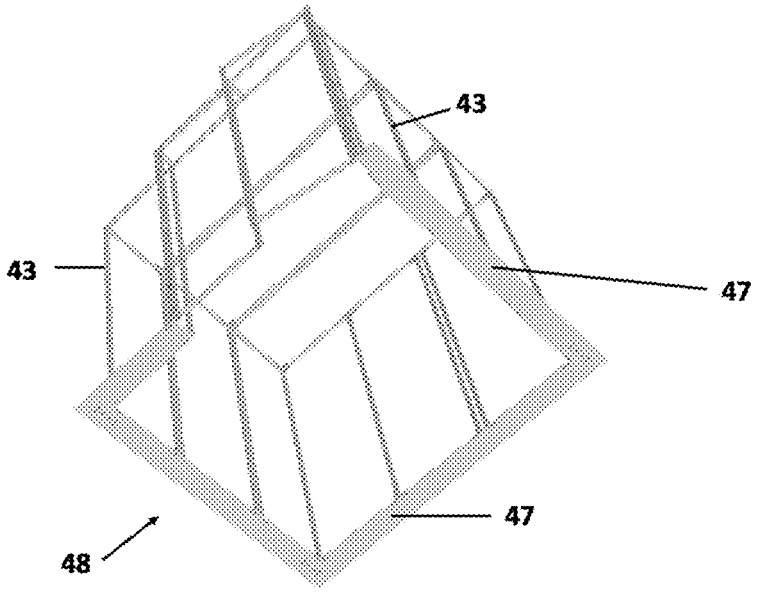
FIG. 10F is a perspective view of the cage of FIG. 10A as seen from the underside of the cage.

In one aspect, it can be desired to attach the sound attenuation panels to a permanent internal or external framing system for example, when the structure has the capacity to accommodate at least 40, at least 50, at least 60, at least 70, at least 80, at least 90, at least 100, at least 150, at least 200, at least 300, at least 500 or more individual seats, boxes, cases, crates, people or animals. As shown in FIG. 10A, illustrated is a tent pole cage structure 48 made with T-Slot extruded tubing, though the tubing can be larger in diameter depending on the structure size as would be known to the skilled artisan. The extruded frames, including but not limited to I-Slot frames and coupling devices are available from a variety of sources such as MiSUMi, Schambury, Ill. http://us.misumi-ec.com and 80/201ID, Inc. https://8020.net/shop. FIG. 10A illustrates structure 48 which can be modified to have a swing door 49 and can be mounted to a floor plate 47. FIG. 10B provides a close up view of the top of structure 48 and FIG. 10C is a magnified view 24 of the assembly of the tent pole frame with right angle bracket 36 to join two frames at right angles and bracket 37 to join four frames, two frames side-by-side to two other frames side-by-side at 90 degrees to the first two frames. FIG. 10D illustrates the lower assembly of structure 48 to the floor plate 47 and FIG. 10E is a magnified view 26 of the assembly of the tent pole frame using right angle bracket 36 to join the pole frame at aright angle to the floor plate 47 and the connecting plate 38 to join two floor plates 48 with screws attaching plate 38 to floor plates 47 at right angles or linearly. FIG. 10F is a perspective view of the underside of FIG. 10A to show the connecting of the poles 43 to the floor plate 47 and the joining of the floor plates as shown in FIG. 10E.

Advantageously, enclosures fabricated using the sound attenuation panels, cores and structures of the present invention were found to have exceptional insertion losses. For example, one test enclosure was found to have insertion losses of over 50 dB at about 2,000 Hz and above, where a 10 dB reduction in sound level can be perceived as a halving or more of the loudness. In one aspect, varying the weight of SAM selected as well as using two or more sheets of SAM on each barrier surface can also improve STC levels achieved with the disclosed inflatable cores, panels and structures.

It has also been determined that the use of SAM to cover the predominant surfaces of the inflatable core also increases the R-value due to the insulating properties of the SAM and the air space between the surfaces of the inflated inflatable core. Thus, the disclose invention finds uses in providing a combined insulation and soundproofing solution, with or without a frame, depending on the application.

Examples of Alternatives and Uses

The sound attenuation, insulation, blocking and containment systems and devices of the present invention are preferably configurable in different shapes and sizes, allowing them to be used for a variety of purposes, including, but not limited to, the construction of the following types of sound barrier structures in which soundproofing qualities are desired: Office cubicles, offices, meeting and conference rooms, Trade Show booths/rooms, negotiation booths, partitions and booth enclosures, Musical Instrument Practice Rooms, Home Recording Studios, Home Theater Rooms, Game/Play/Study Rooms, Factory Floor Control Rooms, Dust, Particulate and Fiber-Free Clean Rooms, Sound Deadening Walls, Ceilings, and Flooring for internal use (for example, to provide temporary soundproofing to homes, apartments, townhouses and condominiums when repair work is being done in other nearby homes or units.) In addition, the disclosed invention can be used to provide HIPAA-compliant medical conversation spaces, ICU partitions, sterility enclosures, sound isolation and sound therapy rooms and mobile army surgical hospital (M.A.S.H.) units. The disclosed invention offers the unmet need for improvement in the delivery of medical care in a quiet environment while facilitating patient monitoring and observation activities. Additionally, the disclosed inflatable core can be light enough that it can even be attached to surfaces using heavy-duty Velcro® strips, magnets and combinations thereof.

In one aspect as little as one panel can be installed to act as a simple wall or ceiling barrier between noisy apartments, i.e., can be 48"×96, including or plus the width of a frame, if desired. Assembled combinations of panels can be used for sound containment walls for external use (for example to use as temporary sound barriers when a road-construction detour has to be put in place through a residential neighborhood), sound deflecting walls (for example to be used as a freeway sound barriers in circumstances where permanent walls are not possible), temporary, outdoor music amphitheater shells and aircraft engine run-up hangars/areas (for military or civilian use.)

Because in certain aspects a solid or a fluid (gas or liquid) such as air can be used to provide the rigidity to the "supportive shell" (e.g., inflatable core) onto which the acoustic barrier material can be applied, the combined materials remain light enough to make the system in accordance with the present invention easily portable/movable, allowing for the design and construction of structures appropriate for use even inside the average residential building, since they will generally weigh less per square foot than a waterbed. In one aspect the inflatable cores can be constructed with transparent/clear SAM(s) to allow ambient light into the structure, partition or panel to provide amore constructive and productive work environment, facilitate collaborative interaction with colleagues. The chambers can also be fitted with UV filtering features. Furthermore, in one embodiment, non-structural ISAT panels weigh as little as 11 lbs each, therefore making it easy for an adult of almost any size able to deploy them.

For the uses described above, a fully-enclosed "room within a room," or a shell comprising various combinations of walls, ceiling and flooring that does not form a fully enclosed "room within a room," will provide useful sound attenuation characteristics that provide a user with a place to listen to or create or block out relatively loud sounds, thus allowing one to avoid/limit the imposition of noise nuisance on those outside the structure, and/or provide a quiet room that keeps loud sounds out. Uses include, but are not limited to: a portable or instant conference room, office partitions, quitter cubicle and communal work environments, trade show conversation and negotiation booths; art isolation and contemplation areas in museums, a place in which to practice playing musical instruments or singing; a home-theater room in which one can listen to high-volume surround-sound systems; a place for children to play noisy games (such as video games, group board games or even the boisterous play of young children); and a quiet room for study, privacy, meditation, mindfulness/wellness training or prayer.

The system can also be preferably deployable outdoors. The panels are preferably waterproof and can be exposed to significant temperature fluctuations (heat and cold).

In one embodiment, the structural ISAT panels in a 24 inch by 27 inch dimension are also easy to pass through a standard door, carry up narrow stairwells and standard elevators while only weighing about 16 pounds. They set up easily, quickly in comparison to conventional soundproofing enclosure components that are excessively large, heavy, and bulky and so precluding accesses to all but large, commercial and industrial spaces. Difficulty of accessibility of conventional soundproofing materials to a target area also includes the need to have excessive assistance, demolition of, not only the target area, potentially access to the target area, with the ensuing dust and dirt, and protracted installation time and effort. Thus, the present invention allows for the development of structures (as described, and others) with considerable soundproofing qualities that can be deployed in spaces or places that previously could not have easily or affordably accommodated such structures.

Additional Notable Aspects of the Invention

In one embodiment, the inflatable core can be equipped with at least one internal sound baffle. The baffle(s) not only assist in establishing a substantially cuboidal surface for the predominant barrier surface of the inflatable core but can be varied in number, placement, height, shape, diameter(s), etc. to facilitate and contribute to a flat (parallel predominant surfaces), undulated, protruding (convex), depressed (concave) or corrugated surface(s) of the inflatable core. The possibility to further augment the inflatable core with additional inflatable core sound baffles, each filed with the same or a different gas or fluid or solid or a combination thereof can provide enhanced sound attenuation.

EXAMPLES

Evaluations of the compressible sound attenuation core for "sound transmission testing" for Transmission Loss (TL) of airborne sound were conducted on a sound attenuation core within a Structural ISAT Panel having variable weights and layers of a SAM. Testing was performed in an accredited laboratory testing facility in the U.S. Testing was performed according to ASTM E90, Standard Test Method for Laboratory Measurement of Airborne Sound Transmission Loss of Building Partitions (http://www.astm.org/cgi-bin/resolver.cgi?E90-09(2016).

Example 1

The purpose of this test was to determine the STC value and sound absorption properties of a sound attenuation core (with 20 baffles/panel) assembled into a Structural ISAT Panel system having four panels (24"×27" each) assembled together in a two by two configuration. Each panel had two SAM layers (one layer of MLV (1 pound/foot$^2$ on SAM layers on each of the exterior and interior predominant surface of the sound attenuation core. STC values were determined by applying the TL values to the STC reference contour of ASTM: E413, "Determination of Sound Transmission Class". TL values were obtained by measuring sound travel in a single direction, from Source Room to Receiving Room, and were measured at 19 sound frequencies ranging from 80 to 5000 with TL values ranging from 16 to 59 decibels (dB). Transmission Loss at each frequency was determined from the following calculation:

$$TL=NR+10 \log S-10 \log A2$$

Where: TL=Transmission Loss (dB), NR=Noise Reduction (dB), S=Surface area common to both sides (sq·ft), A2=Sound absorption of the receiving room with the sample in place (sabins).

The OITC testing procedure followed ASTM:E1332(10), "Determination of Outdoor-Indoor Transmission Class". The sound TL values in the 80 to 4000 Hz range were used to determine the A-weighted sound level reduction of the specimen from the reference source spectrum specified in Table 1 of ASTM E1332(10).

The results determined that the Structural ISAT Panel system had a Sound Transmission Class (STC) of 34, deficiencies (Def) of 24, and an Outdoor-Indoor Transmission Class (OITC) of 26. The total weight of the panel assembly was 62.0 lbs. with a per sq. ft. weight of 3.4 lbs. (data not shown). It is noted that an earlier test resulted in an STC of 38 (data not shown).

Conclusion: At a STC of 35, loud speech is audible but not intelligible. A partition wall (barrier) made of a single layer of ½" drywall on each side of the wall, constructed from wood studs and with no insulation (a typical interior wall) had a STC of 33. Thus, the panel as tested was an improvement to a standard wall partition at blocking loud speech.

Example II

The purpose of this test was to determine the STC value and evaluate the impact of a double thickness of MLV facing the sound source on the sound absorption properties of a sound attenuation core (with 20 baffles/panel) assembled into a Structural ISAT Panel system having four panels (24"×27" each) assembled together in a two by two configuration. Each panel had two SAM layers (one layer of MLV (1 pound/foot$^2$) on each predominant surface of the sound attenuation core. Unlike Example I, an additional layer of MLV (1 pound/foot$^2$) was applied atop the exterior (sound source side) MLV layer with double-sided tape and the edges taped with vinyl tape to the surface of the aluminum frame and panel seams remained exposed. The testing was conducted as described in Example 1.

The results determined that the Structural ISAT Panel system had a Sound Transmission Class (STC) of 37, deficiencies (Def) of 27, and an Outdoor-Indoor Transmission Class (OITC) of 29. The total weight of the panel assembly was 77.0 lbs. with a per sq. ft. weight of 4.3 lbs. (data not shown).

Conclusion: At an STC of 35, loud speech is audible but not intelligible. A partition wall (barrier) made of a single layer of ½" drywall on each side of the wall, constructed from wood studs with no insulation (a typical interior wall) had an STC of 33, and with added fiberglass insulation the STC increases to 39. Thus, the panel as tested was an improvement to a standard wall partition at blocking loud speech and on par with a fiberglass insulated wall.

Example III

The purpose of this test was to determine the STC value and evaluate the impact of a double thickness of MLV facing the sound source plus an additional layer of lighter MLV on the interior surface on the sound absorption properties of a sound attenuation core (with 20 baffles/panel) assembled into a Structural ISAT Panel system having four panels (24"×27" each) assembled together in a two by two panel configuration. Each panel had two SAM layers (one layer of MLV (1 pound/foot$^2$) on each predominant surface of the sound attenuation core. An additional layer of MLV (1 pound/foot$^2$) was applied to the exterior MLV layer with double-sided tape and an additional layer of MLV (0.5 pound/foot$^2$) was applied to the interior MLV layer with double-sided tape. The edges of the additional MLV layers were taped with vinyl tape to the surface of the aluminum frame and panel seams remained exposed. The testing was conducted as described in Example 1.

The results determined that the Structural ISAI Panel system had a Sound Transmission Class (STC) of 40, deficiencies (Def) of 31, and an Outdoor-Indoor Transmission Class (OITC) of 31. The total weight of the panel assembly was 84.5 lbs. with a per sq. ft. weight of 4.7 lbs. (data not shown).

Conclusion: An STC of 40 is considered the onset of 'privacy'. A partition wall (barrier) made of a single layer of ½" drywall on each side of the wall constructed from wood studs with fiberglass insulation has an STC of 39. Thus, the panel as tested was an improvement to a standard wall partition at blocking loud speech and on par with a fiberglass insulated wall.

Example IV

The purpose of this test was to conduct acoustical testing and measure the Noise Reduction Coefficient (NRC) of a Structural ISAT Panel system, each panel having two SAM layers of MLV (each MLV layer at 1 pound/foot$^2$) separated by an inflatable core. One SAM layer can be affixed to each of the exterior and interior predominant surfaces of the inflatable chamber within the sound attenuation core. Each sound attenuation core (with 20 baffles/panel) was assembled into a Structural ISAI Panel system from the six panel (27"×24" each) "building blocks" in a two by three panel configuration (54"×72") for the initial test. The panels were then tested as second time after the addition of Sonex® Value Line 35 foam panels were secured to the assembly on both sides with double-faced tape. The Sonex Value Line 35 Foam panels measured 21½"×24½" and weighted 0.24 lbs each.

The sound absorption test was conducted as specified in ASTM C 423-09a "Sound Absorption and Sound Absorption Coefficient by the Reverberation Room Method". The assemblies were position on the floor in a Type K mounting method. Measuring sound absorption coefficients at 250, 500, 1000, and 2000 Hz and rounding each value to the nearest 0.05 calculated the NRC value. Sound Absorption Average (SAA) was calculated by rounding the sound absorption coefficients (one-third octave bands) for the twelve frequencies from 200 Hz to 2500 Hz to the nearest 0.01.

The results for the first test (minus foam panels) determined that the Structural ISAT Panel system had a NRC of 0.20 and an SAA of 0.19 (data not shown). When foam was also applied to both predominant surfaces of the assembly, atop the SAM, the Structural ISAT Panel system had a NRC of 0.85 and an SAA of 0.82 (data not shown). Alone, the Sonex Value Line 35 foam wall panel was reported to have an NRC of 0.75.

Conclusion: The acoustical properties of the Structural ISAT Panel system with the addition of the Sonex Value Line 35 foam wall panel improved sound absorption approximately four-fold suggesting that the SAM material (one pound/sq. ft. MLV) surface alone has the ability to reflect sound energy while the foam strongly absorbs sound energy. Thus, the Structural ISAT Panel system with the addition of foam panel s improved the sound absorptive properties of the systems as a whole. Significantly, there appeared to be a potential synergistic effect when Sonex® Value Line 35 foam panels are used with the Structural ISAT Panel system.

Example V

The purpose of this test was to determine the Effective Thermal Resistance of a Structural ISAT Panel system, each panel having two SAM layers of MLV (each MLV layer at 1 pound/foot$^2$) separated by an inflatable core. One SAM layer was affixed to each of the exterior and interior predominant surfaces of the inflatable chamber within the sound attenuation core. The test measured the steady state thermal transmission through a test sample using a heat flow meter apparatus with ASTM C518-10 "Standard Test Method for Steady-State Thermal Transmission Properties by Means of the Heat Flow Meter Apparatus" used as a procedural guide because the sample was not homogenous. Thus, the resulting values indicate Effective Resistivity for the sample tested. Thus, it would be expected to have slight variation of other samples due to the specific composition of other samples. The test was a comparative method in which the sample was compared to a standard reference material traceable to NIST. The traceable material was also used to calibrate the heat flow meter apparatus.

The results for the test determined that the Structural ISAT Panel system had a Heat Flux=35 Btu/(h·ft$^2$), Thermal Conductivity=1.84674 Btu·in/(h·ft$^2$), Thermal Conductance=0.462 Btu/(h·ft$^2$), Thermal Resistivity=0.54° F.·ft$^2$·h/Btu/in, and Thermal Resistance, "R" Value=2.16° F.·ft$^2$·h/Btu (data not shown).

Conclusion: The Thermal Resistance, "R" Value of the Structural ISAT Panel system is 2.16 which is over 2.5 times greater than the R value for poured concrete, brick, glass and most hardwoods (see https://en.wikipedia.org/wiki/R-value_(insulation)). Thus, the Structural ISAT Panel system has enhanced thermal performance versus many common construction materials, offers transparency, low-carbon footprint, recyclability, portability, and easy of assembly and storage.

In one embodiment, the disclosed invention includes the invention of an extruded tube as a frame, designed to be light yet of superior tensile strength to support the envisioned panels, partitions, walls, enclosures and structures with connecting devices invented to connect the invented extrusion frame as illustrated in FIGS. 5A-5I. The panels framed with the novel tubes as frames have a substantially reduced compressed width, increased strength and when used with connecting devices easily and quickly facilitate assembly of sound attenuation walls, partitions, rooms, structures and enclosures with no requirement of special tools, training, expertise or equipment. Moreover, due to the modularity of the inflatable cores in a framed custom sized panel, the carbon footprint, shipping costs, ease of transport, rapidity and ease of assembly substantially reduces shipping and labor costs for delivery and assembly as well as disassembly time/labor and storage space requirements. Thus, the present invention allows for the development of structures (as described, and others) with considerable soundproofing qualities that can be deployed in spaces or places that previously could not have easily accommodated soundproofing, or affordably accommodated soundproofing without the disclosed innovative cores, panels and structures. The presently disclosed invention makes soundproofing an easily affordable and specification included requirement for new architectural designs as well as for retrofitting, renovations, can be cleaner, quieter, suitable for residential, industrial and commercial work environments and areas that provide quiet and facilitate concentration, productivity and creativity in the home, school, community groups, office, trade shows, conferences, hospitals etc. Moreover, the disclosed invention has applications in nautical, aviation, military, dust-free manufacturing, e.g., microchip and nanofabrications and circuit board assembly, as can be envisioned by the skilled artisan.

Sound Attenuation Panel Connecting Devices:

The invented sound attenuation panel connecting devices comprise a series of devices used to attach a set of sound attenuating panels together in order to form specific configurations and structure types. In certain aspects, a connector can also act as a noise-attenuating component in its own right, helping to prevent any "leakage" of sound through the cracks between each of the panels. A connector device preferably includes a rigid structure. Connector devices can take on many different shapes and sizes designed to facilitate joining together a series of panels at logical places (such as wall mid-sections, wall corners, ceiling pieces, etc.). Connections can be at any angle depending on the geometric shape of the panel, the geometric shape of the structure the panels are forming, including but not limited to cuboidal, spherical, geodesic, conical, pyramidal, angular, and so on. In certain aspects, a connector device or the intersection of two frame members can also be coated or layered with one or more layers of acoustic barrier (e.g., a mass-loaded vinyl barrier) material. In another embodiment, the frame as illustrated in FIGS. 3A-3B can have a gasket that can be fitted into groove 56 of two adjacent panels to preclude sound leakage.

Larger structures can include a tent-pole cage construction for panel attachment to provide strength, stability and support where long open expanses are built such as conference rooms, performance shells and auditoriums, entertainment shelters, exhibit halls and areas, storage areas, etc. that can accommodate at least 40, at least 50, at least 60, at least 70, at least 80, at least 90, at least 100, at least 150, at least 200, at least 300, at least 500 or more individual seats, boxes, cases, crates, people or animals. Additionally, the cage could be used to support and assist in the portability of aircraft engine run-up hangars to which panels are attached.

Flooring:

A sound-insulating flooring system for structures made with the sound attenuation systems of the present invention can be included if desired. If desired, additional panels of the inflatable sound attenuation system can be inserted underneath a raised flooring system to provide additional sound attenuation qualities to the floors of any given structure.

Ventilation:

According to one aspect, an inflatable sound attenuating system panel and/or a single or multiple-piece room structures include features that allow for fresh air to be constantly circulated into the structure through the use of an optional HVAC system that has noise-limiting features of its own. This ventilation system can be comprised of a special "ventilation-facilitating" sound attenuating panel (or a section of the wall of the single-piece inflatable rooms) that has a series of baffled air conduits built into it (filtering through commercially available, non-toxic acoustic-barrier foam), so that air can be pushed through the walls, in both directions, while maintaining the maximum sound barrier qualities of the system. For example, in one aspect, air can be pushed/pulled through the "ventilation-facilitating" section of the structure (e.g., panel and/or coupling element) using a commercially available fan. In another aspect, airflow can be achieved by pushing/pulling air (or another gas, e.g., oxygen) through small passageways created in the frames disclosed and described in such a way as to minimize sound transmission/penetration via such passageways, including but not limited to using a baffled construction approach as is known to the skilled artisan.

Power-Supply:

In one aspect, a power cord can be integrated with or inserted through a small, specifically baffled/foamed "port" (giving it as much soundproofing quality as possible) in the corner of either one particular panel of a room assembled with panels or of a single-piece structure. The system can include built in power panels or plug systems as desired. For example, a coupling element or a panel can include an integrated power supply.

Lighting:

In one aspect, some or all of the panels used to construct an enclosure, structure or parts of a single-piece room (window areas of panels and doors) can be constructed using lightly opaque or clear materials (both the material used to construct inflatable cores and SAMs are available in a variety of opacities), in order to let natural/room light into the structure, or users can use their own lighting devices as they choose inside the structure. The system can also include security key pads, including but not limited to pass card, biometric identification and code entry as well as lighting fixtures or systems as desired integrated into the frame or attached to the frame, e.g., LED light strips located within or attached to the frame(s) of panels, structures or enclosures. The LED lights can illuminate individual clear or translucent panels and be controlled by a computer chip/ARDUINO-type microcontroller such that each individual panel can act as a 'pixel' and specialty lighting effects and/or text messages can be 'scrolled' on/in each panel for artistic, esthetic and/or marketing purposes.

Unframed Inflatable Structures:

In one aspect an inflatable core can be constructed as a continuously running length of at least 100 feet or meters or more and of varying width and thickness to allow it to fit within the structural framing of, including but not limited to a house, e.g., 16" on center with either 6" or 4" frame depth when framing with a 2"×6" or 2"×4" boards in lengths such as about 8 feet, 9 feet, 10 feet, 12, feet or more as is known to one of skill in the building arts. This allows for the length of the inflatable core to be cut on sight to accommodate non-standard, e.g., less than 8 feet or greater, e.g., cathedral ceiling heights and angles and heat-sealed. In one embodiment the selection of a SAM material can be varied to provide the level of soundproofing and R-value desired. The SAM material can be attached on sight to the custom-sized inflated inflatable core on one or both predominant surfaces and then installed.

In another embodiment the shape, size and contours of an inflated structure can be designed based on creating cuboidal surfaces or contours to the inflatable core. The contoured cores can form geometrical shapes including but not limited to igloo and dome, pyramid-like or cone-like. When the contoured cores of the custom shaped structure are interconnected/sealed together with interconnected fluid valve ports between cores the inflation of the cores in tandem can result in a freestanding inflatable structure. Such structures can have HVAC and lighting systems but avoid the necessity of a continuously running blower to introduce air to keep the structure inflated. Thus, when inflated the structure provides an enclosure suitable for a variety of purpose as previously described. The inner and/or outer walls of the inflated structure can include a sound attenuation material attached thereto; for example, one or multiple sheets of MLV attached to the core(s) barrier surface(s). The sound attenuation material sheet(s) can be pre-attached or attached by a user after the structure has been inflated, partially or entirely. In certain aspects, the structure can include an integrated self-inflation device, although ports can be provided to allow for connectivity with an external pump. Inflation via fluid flow can be continuous or non-continuous. Air ventilation ports can also be provide d to allow connectivity with an external ventilation system. An entry portion (e.g., door) can be preferably provided to allow one to enter and leave the structure. Additional support elements can be used to provide structural integrity.

Each single-piece structure (including but not limited to an office partition, trade showbooth, conference room, practice room, home theatre, game room, etc.) can be preferably equipped with one or more high-performance internal inflation pump(s), in order to allow users to simply plug in the device and inflate the room to its full size automatically.

Individual panels are equipped with one or more inflation valves that can either be used in conjunction with standard air mattress-type pumps (for smaller panels) or industrial-grade inflation devices (for freeway walls, airplane engine run up hangars, etc.) In one aspect, each panel includes an individual inflation device built into or otherwise integrated with the core. The valve(s) can be placed on any surface of the core, and more than one valve can be provided, in order to facilitate inflation and/or deflation of the core at all times (e.g. if additional inflation of cores can be desired when a wall or a room is already set up.)

For larger barriers, Helium or other low-density gas can be used to inflate a core. For example, the use of Helium provides additional ease of deployment and inflation of the inflatable core to provide support to assist to raise or lift the inflated core.

In one aspect a core might include a side pocket configured to receive and hold a rigid material such as aboard or a telescoping pole that can be interconnected to other poles as can be done with a light-weight tent so as to provide additional structural support.

Additional Features:

For each category of use possible for the ISAT™ system (such as soundproof rooms, freeway walls, airport hangars, medical rooms, insulating walls, insulation of shipping, airline, space ship, automotive and other transportation modes), a variety of colors/sizes/shapes/use categories are available. Sizes can be compatible with dimensional lumber, e.g., 4'×8', 4'×10', 4'×12', construction bracing, e.g., 12", 14" 16", 18" wide on center, as well as metric dimensions and bracing as is known to one of skill in the art, etc., Examples of variations on soundproof rooms, for instance, include: Sizes for Practice Studios: Individual-sized enclosure for single instrument practice, a vocal booth, and recording an audio or video presentation. Practice rooms that hold larger groups of people/instruments. Longer/Narrower shaped rooms for enclosing an upright practice piano. Wider/Squarer shaped rooms for enclosing a grand piano. Various colors for panels and structures, e.g., rooms and practice studios can be used: Add-ons for various inflatable rooms might include: "Inflatable Recording Studio" with additional sound absorption material (e.g. acoustic foam) on the walls. "Inflatable Home Theater" with special containers built into the walls to hang/place various sizes of speakers. "Inflatable Play Room" with various types of child-safe play structures built into the enclosure, such as a maze or mini-slides. "Dance Practice Room" with an ISAT system installed within the raised floor as well as mirrors hung on the room's wall(s). Portable conference rooms, meeting rooms and the like are also envisioned.

In one aspect the configuration and positioning of internal sound baffles can incorporate corporate branding, or design appealing to a child, team or institution such as a school, place of worship, organization, etc. Designs might include team logos, mascots, Greek letters, mottos, symbols, emblem, totem, trademark, insignia, monogram, stamp, crest and coat of arms, etc.

Kits

In one embodiment, a portable system including but not limited to a portable, inflatable "Instant Recording Studio" can be provide d in a container or carrying device such as a suitcase or a crate that can also be used as a table or stand. The carrying device or outer shell might include handles and roller wheels to facilitate transport, and the contents might include, in addition to the panels and connectors that would create one or more walls or a room, a built-in air circulation system and power supply and inflation device for inflation of panel components making up the system. There can also be included panel connectors, fabrics or felts, foams, air fans/circulation/HVAC device, electrical cords and connections, lighting, e.g., LED lighting, internet ports, instructions for: assembly, use, and cleaning. Panels can be packaged in a "road case" type box, with or without wheels, for easy and safe commercial transport, deployment and storage.

In an alternative embodiment, an inflatable sound attenuation core can be made up of a sound attenuating material so that additional sheets or layers of sound attenuating material (e.g., MLV) may not be needed. This can result in less sound attenuation but can provide for more portability.

For some structures, additional support can be desired to help support the panels or overall structure. Examples might include floor or wall braces and anchors and other similar bracing devices.

Preferably, a sound attenuation material (e.g., MLV) can cover an inflatable core or an inflatable structure, on the barrier surfaces/predominant surfaces facing inside and/or facing out. For example, a single sheet of MLV can be attached to support multiple inflatable cores. Alternatively, only a portion or one side of an inflatable core can be covered, preferably such that when a structure can be erected, the structure has sound attenuation material fully surrounding it, either interiorly or exteriorly, or at least on one side in the case where the structure may not be fully enclosed.

A cover can be provided to cover components or completed structures if desired. The cover can be preferably made of cloth, noise absorbing material or other suitable material to provide protection, decoration, alter the fragrance of the materials, etc. (e.g., burlap carbon curtain).

In one aspect, a clear, rigid acrylic material can be used to construct the frame(s), coupling elements and support tent poles, beams. For example, when made of clear polycarbonate, the frame(s) in combination with clear MLV and clear PVC air inflated inflatable cores of the panels, as much light from the outside as possible can be allowed into the structure (hence no electric lights are needed). In another aspect, the coupling elements and support beams are made of rigid, opaque PVC, for example where making a booth where darkness inside a booth can be a desired feature (in which case an opaque MLV and an opaque air inflatable core would also preferably be used.)

While the invention has been described by way of example and in terms of the specific embodiments, it is to be understood that the invention is not limited to the disclosed embodiments. To the contrary, it can be intended to cover various modifications and similar arrangements as would be apparent to those skilled in the art. For example, coupling elements and devices can also comprise an inflatable core. Therefore, the scope of the appended claims should be accorded the broadest interpretation so as to encompass all such modifications and similar arrangements.

While the principles of this invention have been described in connection with specific embodiments, it should be understood clearly that these descriptions are made only by way of example and are not intended to limit the scope of the invention. What has been disclosed herein has been provided for the purposes of illustration and description. It is not intended to be exhaustive or to limit what can be disclosed to the precise forms, dimensions or shapes described. Many modifications and variations will be apparent to the practitioner skilled in the art. What is disclosed was chosen and described in order to best explain the principles and practical application of the disclosed embodiments of the art described, thereby enabling others skilled in the art to understand the various embodiments and various modifications that are suited to the particular use contemplated. Itis intended that the scope of what is disclosed be defined by the following claims and their equivalence.

What is claimed is:

1. A compressible sound attenuation core comprising:

at least one inflatable chamber comprising an interior portion defining said at least one inflatable chamber, and at least one three-dimensional shaped sound baffle, each said at least one baffle being within the interior portion of one of said at least one inflatable chamber, each said baffle having a first portion extending from a first interior surface of said interior portion and a second portion extending from a second interior surface of said interior portion, said second interior surface being opposite said first interior surface, said first portion and said second portion having a shape selected from the group consisting of conical, cylindrical, concentric, rectangular, pyramidal, cuboidal and combinations thereof, each said baffle having a middle portion connecting said first portion of said respective baffle to said second portion of said respective baffle;

said first portion of each said baffle, said second portion of said baffle and said middle portion of each said baffle having a longitudinal axis extending substantially perpendicular to said first interior surface and said second interior surface.

2. The compressible sound attenuation core of claim 1 further comprising: at least a first sheet of sound attenuation material adhered to a first exterior surface of the core.

3. The compressible sound attenuation core of claim 2, wherein the first exterior surface of the core having attached thereto the at least first sheet of sound attenuation material is a predominant, barrier surface of the inflatable chamber.

4. The compressible sound attenuation core of claim 3, wherein the at least one baffle provides substantially cuboidal, parallel opposite predominant surfaces of the inflatable chamber.

5. The compressible sound attenuation core of claim 4, wherein the cuboidal, parallel surfaces are predominant, barrier surfaces of the sound attenuation core.

6. The compressible sound attenuation core of claim 2 further comprising: a supporting frame, wherein said frame has a channel for receiving perimeter edges of the at least first sheet of sound attenuation material adhered to the first surface of the core.

7. The compressible sound attenuation core of claim 2, comprising an at least second sheet of sound attenuation material affixed to at least one of the first sound attenuation material or a second exterior surface opposite the first surface of the core.

8. The compressible sound attenuation core of claim 7, wherein the second sheet of sound attenuation material is identical to the first sheet of sound attenuation material.

9. The compressible sound attenuation core of claim 7, wherein the second sheet of sound attenuation material is different from the first sheet of sound attenuation material.

10. The compressible sound attenuation core of claim 9, wherein the second sheet of sound attenuation material is affixed to the second surface opposite the first surface of the core.

11. The compressible sound attenuation core of claim 7, wherein the second sheet of sound attenuation material is affixed to the second surface opposite the first surface of the core.

12. The compressible sound attenuation core of claim 2, wherein the sound attenuation material (SAM) is selected from the group consisting of one or more mass loaded vinyl (MLV), thermoplastic polyurethane (TPU), rubber, polyvinyl chloride (PVC), High-Mass/High-Density PVC, a lead-impregnated fabric, a lead-impregnated plastic, a metal-impregnated material, a flexible felt of various thickness, a flexible fabric, fiberglass, quilted fiberglass absorbers, a flexible foam, a rigid foam, melamine foam and polyurethane foam.

13. The compressible sound attenuation core of claim 1, wherein the at least one baffle provides an undulating exterior core surface.

14. The compressible sound attenuation core of claim 1, wherein the one or more sound baffles comprise a chamber filed with a gas, a liquid or a solid.

15. The compressible sound attenuation core of claim 1, wherein each of the at least one inflatable chamber is filed with a gas selected from the group consisting of air, nitrogen, helium, neon, argon, hydrogen and oxygen.

16. A sound attenuation panel comprising:

a.) a compressible sound attenuation core comprising:

at least one inflatable chamber comprising an interior portion defining said at least one inflatable chamber, and at least one three-dimensional shaped sound baffle, each said at least one baffle being within the interior portion of one of said at least one inflatable chamber, each said baffle having a first portion extending from a first interior surface of said interior portion and a second portion extending from a second interior surface of said interior portion, said second interior surface being opposite said first interior surface, said first portion and said second portion having a shape selected from the group consisting of conical, cylindrical, concentric, rectangular, pyramidal, cuboidal and combinations thereof, each said baffle having a middle portion connecting said first portion of said respective baffle to said second portion of said respective baffle;

said first portion of each said baffle, said second portion of said baffle and said middle portion of each said baffle having a longitudinal axis extending substantially perpendicular to said first interior surface and said second interior surface;

and b.) a frame comprising:

i) two parallel longitudinal channels;

ii) a central longitudinal opening; and iii) a longitudinal groove;

wherein the two parallel longitudinal channels are below the central longitudinal opening and; wherein the longitudinal groove is above the central longitudinal opening and opposite the two parallel longitudinal channels.

17. A sound attenuation structure comprising;

a.) a compressible sound attenuation core—comprising:

at least one inflatable chamber comprising an interior portion defining said at least one inflatable chamber, and at least one three-dimensional shaped sound baffle, each said at least one baffle being within the interior portion of one of said at least one inflatable chamber, each said baffle having a first portion extending from a first interior surface of said interior portion and a second portion extending from a second interior surface of said interior portion, said second interior surface being opposite said first interior surface, said first portion and said second portion being conical having a shape selected from the group consisting of conical, cylindrical, concentric, rectangular, pyramidal, cuboidal and combinations thereof, each said baffle having a middle portion connecting said first portion of said respective baffle to said second portion of said respective baffle;

said first portion of each said baffle, said second portion of said baffle and said middle portion of each said baffle having a longitudinal axis extending substantially perpendicular to said first interior surface and said second interior surface; and b.) a frame comprising:

i) two parallel longitudinal channels;

ii) a central longitudinal opening; and iii) a longitudinal groove;

wherein the two parallel longitudinal channels are below the central longitudinal opening and;

wherein the longitudinal groove is above the central longitudinal opening and opposite the two parallel longitudinal channels.

* * * * *